US006498589B1

(12) United States Patent
Horii

(10) Patent No.: US 6,498,589 B1
(45) Date of Patent: Dec. 24, 2002

(54) ANTENNA SYSTEM

(75) Inventor: Shotaro Horii, Kobe (JP)

(73) Assignee: DX Antenna Company, Limited, Kobe (JP)

( * ) Notice: Subject to any disclaimer, the term of this patent is extended or adjusted under 35 U.S.C. 154(b) by 0 days.

(21) Appl. No.: 09/527,427

(22) Filed: Mar. 17, 2000

(30) Foreign Application Priority Data

Mar. 18, 1999 (JP) ..... 11-074065
Jul. 16, 1999 (JP) ..... 11-203307

(51) Int. Cl.[7] ..... H01Q 21/00; H01Q 21/26
(52) U.S. Cl. ..... 343/727; 343/797; 11/818
(58) Field of Search ..... 343/797, 872, 343/745, 871, 722, 818, 792.5, 891, 819, 815, 795, 749, 727, 814, 724, 726

(56) References Cited

U.S. PATENT DOCUMENTS 3,618,103 A * 11/1971 Ringland ..... 343/792.5
3,727,230 A * 4/1973 Doi ..... 343/795
3,727,232 A * 4/1973 Grant ..... 343/815
3,747,112 A * 7/1973 Hidaka ..... 343/749
3,820,018 A * 6/1974 Beasley et al. ..... 324/52
3,875,572 A * 4/1975 Kay ..... 343/803
4,198,641 A * 4/1980 Gibson ..... 343/797
4,218,686 A * 8/1980 Blonder ..... 343/819
4,249,185 A * 2/1981 De Cesari ..... 343/871
4,290,071 A * 9/1981 Fenwick ..... 343/819
4,633,265 A * 12/1986 Wheeler ..... 343/797
5,534,882 A * 7/1996 Lopez ..... 343/891
5,625,367 A * 4/1997 Unwin ..... 343/745
5,898,410 A * 4/1999 DeMarre ..... 343/792.5
6,052,098 A * 4/2000 Killen et al. ..... 343/795
6,154,180 A * 11/2000 Padrick ..... 343/722

* cited by examiner

*Primary Examiner*—Don Wong
*Assistant Examiner*—Chuc Tran
(74) *Attorney, Agent, or Firm*—Duane, Morris LLP

(57) ABSTRACT

An antenna system includes a VHF dipole antenna having a pair of rod elements disposed substantially in a line, and a UHF Yagi antenna having a radiator and a direction disposed on the rod elements.

19 Claims, 34 Drawing Sheets

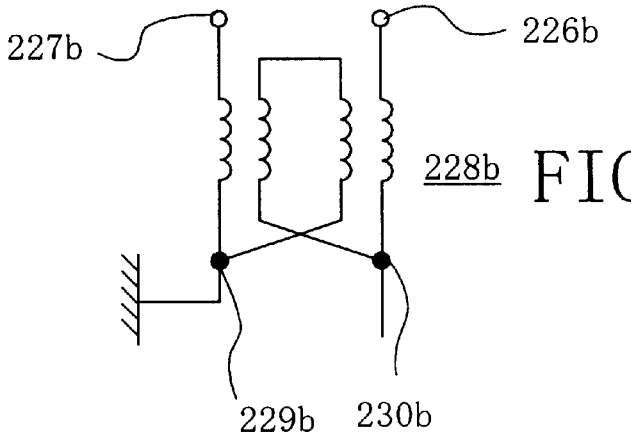
FIG. 30B
FIG. 30A
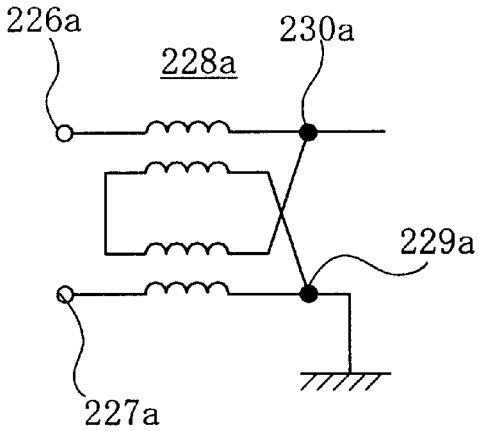
FIG. 30C
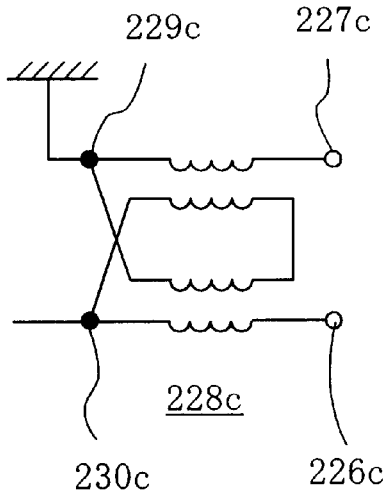
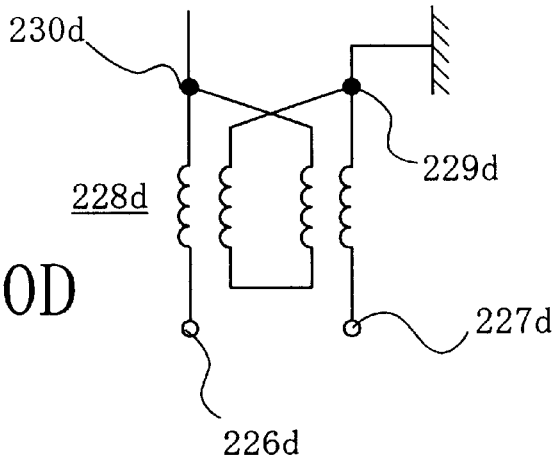
FIG. 30D

A A
A A A

B B B
B

C C C

D D D

E E E E
E E E

F F F F F t1 t2 t3 t4 t5 t6 t7 t8 t9

ANTENNA SYSTEM

BACKGROUND OF THE INVENTION

Antennas mounted on a moving article, such as a television broadcast receiving antenna mounted on a car, may be non-directional. Non-directional antennas include, for example, an Alford loop antenna and a cloverleaf antenna. To receive radio waves in, for example, VHF and UHF bands by means of such non-directional antennas, one for each of the frequency bands has been used.

An Alford loop antenna and a cloverleaf antenna are formed of many components, are large in size and require complicated manufacturing processes. Accordingly, such antennas for receiving UHF and VHF bands undesirably require a large space to mount them because they are large. In addition, non-directional antennas, such as Alford loop antennas and cloverleaf antennas, are subject to receiving undesired radio waves and, therefore, tend to cause ghosts to appear in a television picture when used for receiving television broadcast ratio waves.

An object of the present invention is to provide an antenna which is small in size and can selectively receive radio waves of plural frequency bands. Another object is to provide an antenna which hardly receives undesired radio waves and substantially non-directional in receiving radio waves.

SUMMARY OF THE INVENTION

An antenna system according to one embodiment of the present invention includes a dipole antenna for a first frequency band. The dipole antenna has a pair of rod elements arranged substantially in a straight line. The antenna system also includes a Yagi antenna for a second frequency band higher than the first frequency band, which has a radiator disposed on at least one of the pair of rod elements of the dipole antenna. The first and second frequency bands may be the VHF and UHF bands, respectively.

The Yagi antenna may include, in addition to the radiator, a director and/or a reflector. The Yagi antenna radiator may be disposed at a predetermined angle, e.g. 90°, with respect to the rod elements of the dipole antenna. The radiator may be a folded-dipole antenna. It is desirable to dispose the folded-dipole antenna in such a manner that its longitudinal center is on the rod element of the dipole antenna. The radiator of the Yagi antenna may be a planar radiator.

A plurality of such dipole antennas may be used for the first frequency band. In this case, the rod elements of the different dipole antennas are disposed to extend radially from the same center, and a plurality of Yagi antennas are used with their radiators disposed on the rod elements of the dipole antennas. The radiators may be disposed on the respective rod elements of at least one dipole antenna, or may be disposed on different ones of the dipole antennas. Selecting means selects one of the outputs of the dipole antennas and also one of the outputs of the Yagi antennas. The selecting means may be arranged to select more than one outputs of the antennas.

According to another embodiment of the present invention, an antenna system includes a first Yagi antenna for a first frequency band having at least one director, and a plurality of second Yagi antennas for a second frequency band higher than the first frequency band. The second Yagi antennas have radiators disposed on the at least one director of the first Yagi antenna. The first Yagi antenna may have a plurality of directors. The radiators of the second Yagi antennas may be disposed on one director or on different ones of the directors. The first Yagi antenna also has a radiator. It may have a reflector, too.

An antenna system according to a further embodiment of the present invention includes a first antenna for a first frequency band including a pair of rod elements mounted on a boom, and a second antenna for a second frequency band higher than the first frequency band. The second antenna has a radiator which is mounted on the boom substantially in parallel with the rod elements of the first antenna and can be used as a director of the first antenna.

An antenna system according to a still further embodiment includes a body and a plurality of Yagi antennas all for the same frequency band disposed in the body. The Yagi antennas are arranged at different levels in the body. The Yagi antennas are disposed in the body to be receptive of radio waves from different directions. Parts of the respective antennas intersect without contacting each other. Any one of various shapes may be employed for the body, but a planar body is preferred for space saving. Each Yagi antenna may include at least a radiator and a reflector or at least a radiator and a director. The intersecting parts of the respective Yagi antennas may be parts of the radiators, or the reflectors for the antennas with reflectors.

A plurality of Yagi antennas may be disposed in the plane at each of the different levels for receiving radio waves from different directions.

The plurality of Yagi antennas in one plane may be two Yagi antennas arranged to receive radio waves from opposite directions. In this case, each antenna has a radiator and a reflector. Each radiator is in a flaring shape with its opposite extremities located close to corresponding extremities of the other radiator. Each reflector includes a portion curving toward the associated radiator.

According to a still further embodiment, an antenna system includes a body and a plurality of Yagi antennas disposed in said body for receiving radio waves from different directions. Each of the Yagi antennas has to have only a radiator and a reflector or a radiator and a director. Adjacent ones of the Yagi antennas are at different levels, and Yagi antennas adapted to receive radio waves from directions 180° apart from each other are disposed on the same plane.

Each of the Yagi antennas may be connected to a matching device. Selecting means selects one of outputs of the matching devices of the respective Yagi antennas and combinations of outputs of the matching devices of pairs of adjacent Yagi antennas. Each of the matching devices has first and second output terminals with the first output terminal connected to a reference potential and with the second output terminal connected to the selecting means. With this arrangement, the phases of the antenna outputs provided from the respective matching devices are aligned.

According to a further embodiment of the present invention, an antenna system includes an even number of rod antennas radially extending substantially in the same plane. The number of the rod antennas is equal to or greater than four. The antenna system further includes pairs of feed terminals as many as the rod antennas. Each pair of feed terminals are led from a pair of adjacent ones of the rod antennas, whereby V-shaped antennas as many as the rod antennas are provided.

A matching device may be connected to each pair of the feed terminals. Selecting means selects individual ones of outputs from the respective matching devices and combinations of outputs of the matching devices of pairs of adjacent V-shaped antennas. Also, energizing means is provided for energizing only the selected one or more of the matching devices.

In this embodiment, each rod antenna functions as a component of two V-shaped antennas. Accordingly, in order to avoid its adverse effect, the matching devices associated with the respective antennas operate only when the associated antennas are selected by the selecting means.

Each matching device has first and second output terminals with the first output terminal connected to a reference potential and with the second output terminal connected to the selecting means.

An antenna system according to a further embodiment of the present invention includes a plurality of radially extending rod antennas. Pairs of rod antennas extending diametrically opposite directions substantially in the same plane form a plurality of dipole antennas. The antenna system further includes a pair of feed terminals led from each dipole antenna.

A matching device may be connected to each pair of the feed terminals. Selecting means selects individual ones of outputs from the respective matching devices and combinations of outputs of the matching devices of pairs of adjacent dipole antennas. Also, energizing means is provided for energizing only the selected one or ones of the matching devices.

In this embodiment, too, each rod antenna functions as a component of two dipole antennas. Accordingly, in order to avoid its adverse effect, the matching devices associated with the respective antennas operate only when the associated antennas are selected by the selecting means.

Each matching device has first and second output terminals with the first output terminal connected to a reference potential and with the second output terminal connected to the selecting means.

In accordance with a still another embodiment of the present invention, an antenna system includes a plurality of antennas for the same frequency band disposed to be receptive of radio waves from different directions, selecting means for selecting individual ones of outputs from the respective antennas and combinations of outputs of pairs of adjacent antennas, and control means for providing a selection control signal to the selecting means.

According to a further embodiment of the present invention, an antenna system includes a plurality of first antennas for a first frequency band disposed to be receptive of radio waves in the first frequency band coming from different directions, and a plurality of second antennas for a second frequency band disposed to be receptive of radio waves in the second frequency band coming from different directions and associated with the respective ones of said first antennas. The antenna system further includes the same number of amplifying means as the first and second antennas, each of which receives outputs of one of the first antennas and an associated one of the second antennas. Combining means combines outputs of the amplifying means. The antenna system further includes control means for switching between a state in which the amplifying means are individually energized and a state in which the amplifying means receiving the outputs of pairs of adjacent ones of the first antennas are energized.

According to a still further embodiment of the present invention, a plurality of Yagi antennas are so disposed at different levels in a body as to be receptive of radio waves in a first frequency band coming from various directions. A plurality of rod antennas are disposed at a level different from the levels of the Yagi antennas. The rod antennas are disposed to be receptive of radio waves in a second frequency band coming from various directions. A plurality of Yagi antennas may be disposed at the same level for receiving radio waves from different directions. Also, an even number, not smaller than four, of rod antennas may be used and combined to form V-shaped antennas or dipole antennas. The level at which the rod antennas are disposed may be intermediate between the levels at which the Yagi antennas are disposed.

BRIEF DESCRIPTION OF THE DRAWINGS

FIG. 23B is a perspective view of dipole antennas formed by the rod antennas of the antenna system of FIG. 23.

FIGS. 30A, 30B, 30C and 30D show matching devices in the respective filters shown in FIG. 28.

DETAILED DESCRIPTION OF PREFERRED EMBODIMENTS

Figure 1:
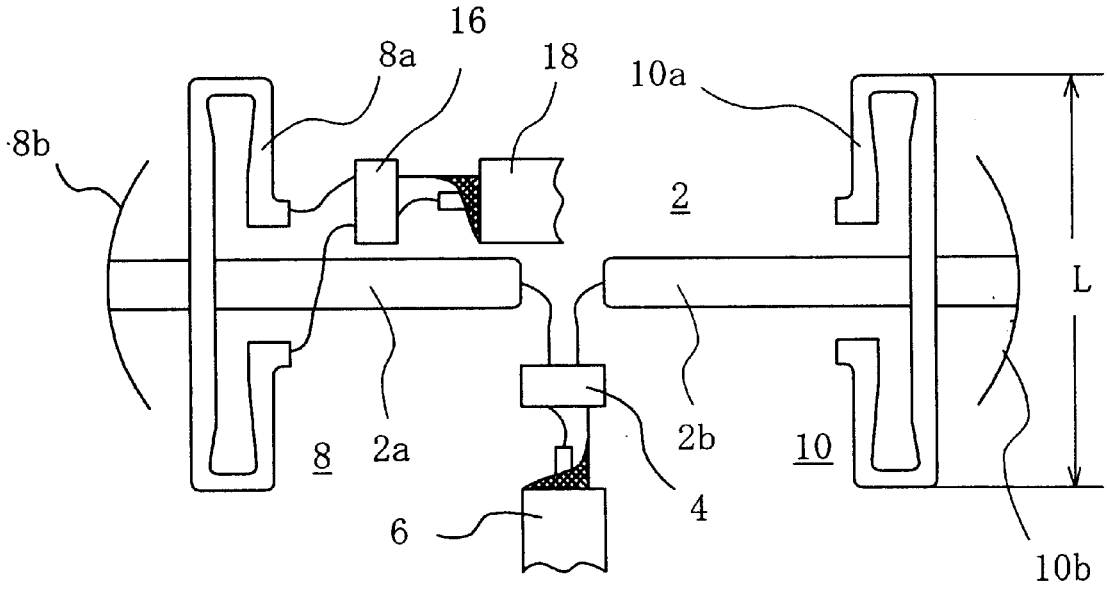
FIG. 1 is a plan view of an antenna system according to a first embodiment of the present invention.
Figure 2:
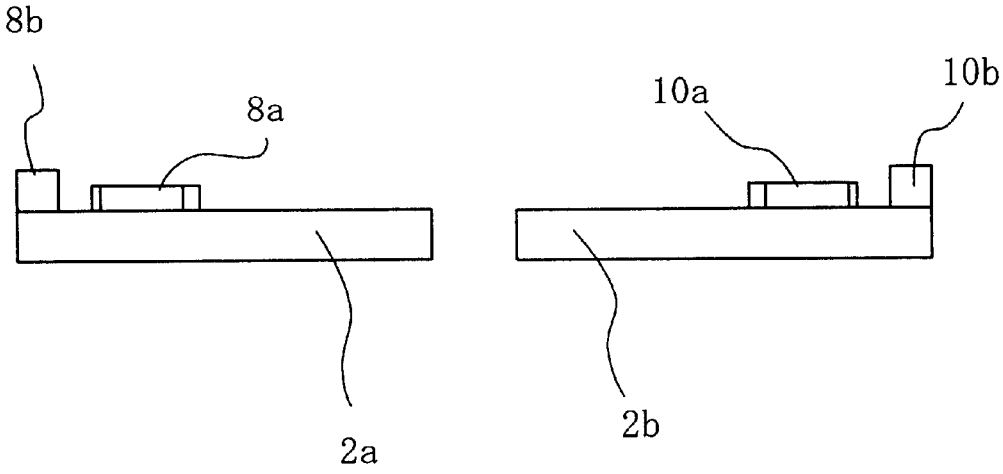
FIG. 2 is a side elevational view of the antenna system shown in FIG. 1.

An antenna system according to a first embodiment of the present invention includes a first frequency-band receiving antenna 2, e.g. a VHF receiving antenna, as shown in FIGS. 1 and 2. The VHF antenna 2 is a dipole antenna formed by a pair of rod elements 2*a* and 2*b* arranged substantially in a line. The rod elements 2*a* and 2*b* has a length shorter than one-fourth of the wavelength $\lambda_V$ at the center frequency of the VHF receiving band. The VHF receiving antenna 2 has such a directional response as to chiefly receive radio waves coming from the direction perpendicular to the line in which the rod elements 2*a* and 2*b* are arranged. The inner or facing ends of the respective rod elements 2*a* and 2*b* are feed sections, which are connected to a coaxial cable through a balun 4.

On the upper surface of the rod elements 2*a* and 2*b*, Yagi antennas 8 and 10 for receiving radio waves in a second frequency band, e.g. a UHF band are disposed. The Yagi antennas 8 and 10 have radiators 8*a* and 10*a*, respectively, which are disposed at locations offset toward the outer ends of the rod elements 2*a* and 2*b*. The radiators 8*a* and 10*a* are provided by flat, folded-dipole antennas. They have a length dimension L, which is equal to one-half of the wavelength $\lambda_U$ at the center frequency of the UHF receiving band. The radiators 8*a* and 10*a* extend in the direction perpendicular to the length direction of the rod elements 2*a* and 2*b* with the centers of the radiators 8*a* and 10*a* contacting the rod elements 2*a* and 2*b*, respectively.

On the upper surface of the rod elements 2*a* and 2*b* at their outer ends, directors 8*b* and 10*b* for the UHF band are disposed. The directors 8*b* and 10*b* have a length determined in relation to frequencies to be received.

The radiator 8*a* and the director 8*b* form the Yagi antenna 8, and the radiator 10*a* and the director 10*b* form the other Yagi antenna 10. The distance between the UHF band directors 8 and the radiator 8*a* and the distance between the UHF band director 10*b* and the radiator 10*a* are determined in the same manner as conventional Yagi antennas. The Yagi antenna 8 has such a directional response as to chiefly receive radio waves coming from the outside of the director 8*b*, i.e. from the left of the director 8*b* in the plane of FIGS. 1 and 2, while the Yagi antenna 10 has such a directional response as to chiefly receive radio waves coming from the outside of the director 10*b*, i.e. from the right of the director 10*b* in the plane of FIGS. 1 and 2.

The radiator 8*a* has feed sections at its folded distal ends, which are connected to a coaxial cable 18 via a balun 16. Similarly, the folded distal ends of the radiator 10*a* provide feed sections for the radiator 10*a*, which are connected to a coaxial cable (not shown) via a balun (not shown). Reflectors may be disposed on the sides of the radiators 8*a* and 10*a* opposite to the directors 8*b* and 10*b*, respectively, so that the radiators 8*a* and 10*a* are located between the associated reflectors and the directors 8*b* and 10*b*, respectively. Also, a larger number of directors may be used.

The antenna system uses the rod elements 2*a* and 2*b* of the VHF receiving antenna 2 as support booms for the UHF receiving antennas 8 and 10. The folded dipole antennas are used as the radiators 8*a* and 10*a* of the UHF receiving antennas 8 and 10 in order for the UHF receiving antennas 8 and 10 to be influenced little by the VHF receiving antenna 2. When the folded dipole antennas are used, the receiving characteristics of the UHF receiving antennas 8 and 10 are affected little even though metal rods forming the rod elements 2*a* and 2*b* of the VHF receiving antenna 2 pass the midpoints between the folded distal ends of the folded dipole antennas. Also, the use of the folded dipole antennas facilitates the feeding because the feed sections thereof are located on the opposite sides of the rod elements 2*a* and 2*b*.

The radiators 8*a* and 10*a* and the directors 8*b* and 10*b* of the UHF receiving antennas 8 and 10 are disposed to directly contact the respective distal end portions of the rod elements 2*a* and 2*b* of the VHF receiving antenna 2, the radiators 8*a* and 10*a* and the directors 8*b* and 10*b* function as capacitance elements for the VHF receiving antenna 2. Accordingly, the rod elements 2*a* and 2*b* can be shorter than usually required, so that the VHF receiving antenna 2 can be made small in size. In addition, since the radiators 8*a* and 10*a* and the directors 8*b* and 10*b* are disposed on the rod elements 2*a* and 2*b* of the VHF receiving antenna 2, no support booms for the radiators 8*a* and 10*a* and the directors 8*b* and 10*b* are required, which permits the UHF receiving antennas to be made small in size. The radiators 8*a* and 10*a* are planar in shape, and, therefore, the UHF receiving antennas 8 and 10 can be made smaller. Since the UHF receiving antennas 8 and 10 and the VHF receiving antenna 2 are small in size, a compact multiple frequency band antenna system can be obtained.

Figure 3:
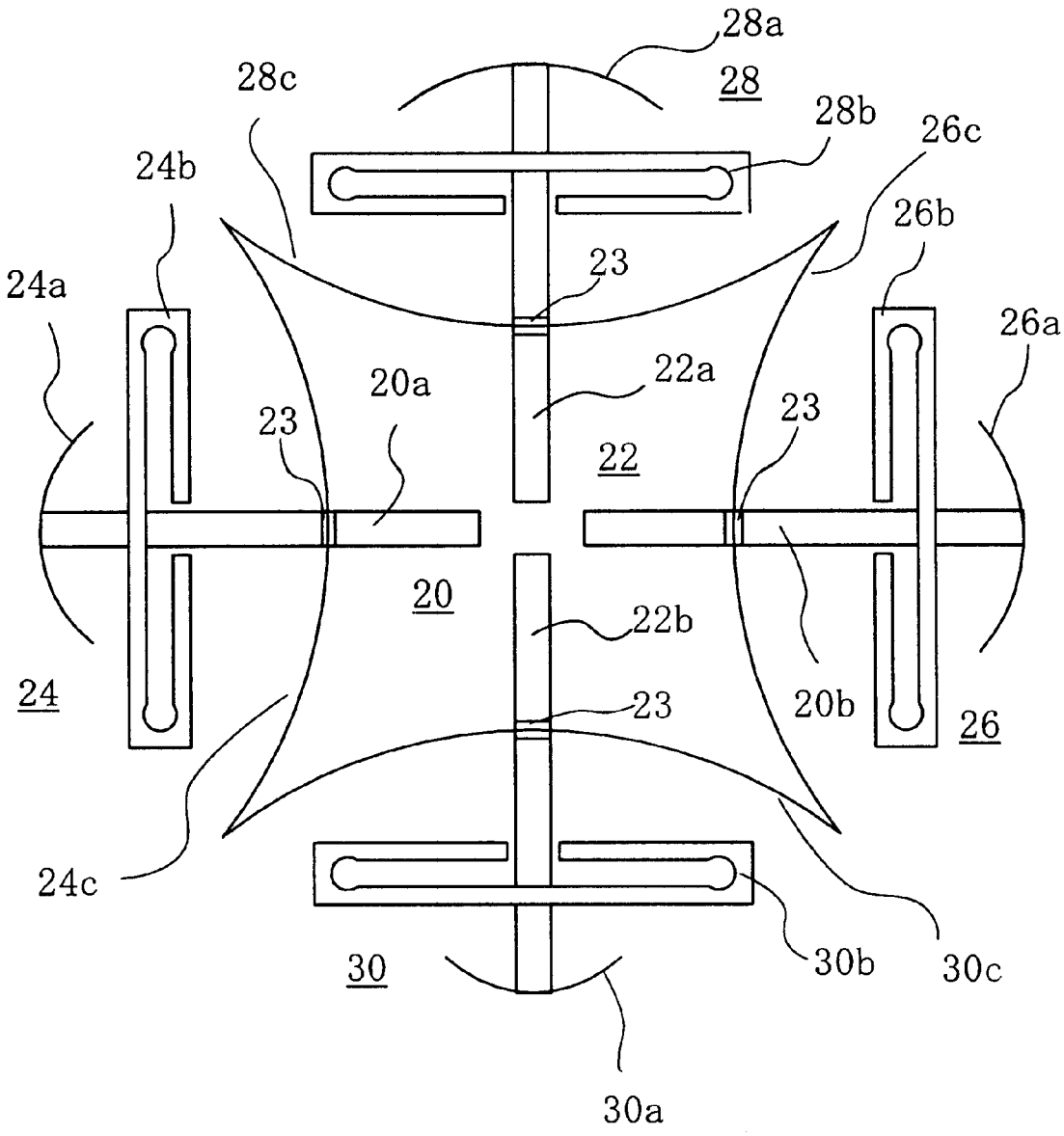
FIG. 3 is a plan view of an antenna system according to a second embodiment of the present invention.
Figure 4A:
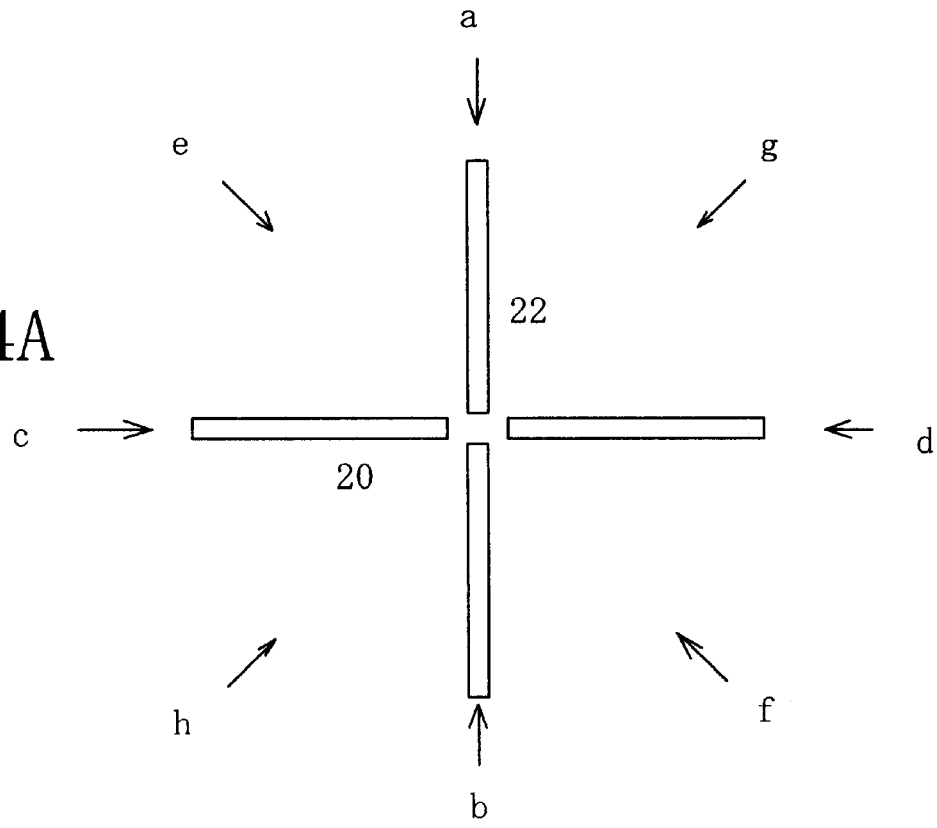
FIGS. 4A and 4B illustrate the directional response of the antenna system shown in FIG. 3 in the VHF and UHF bands, respectively.
Figure 4B:
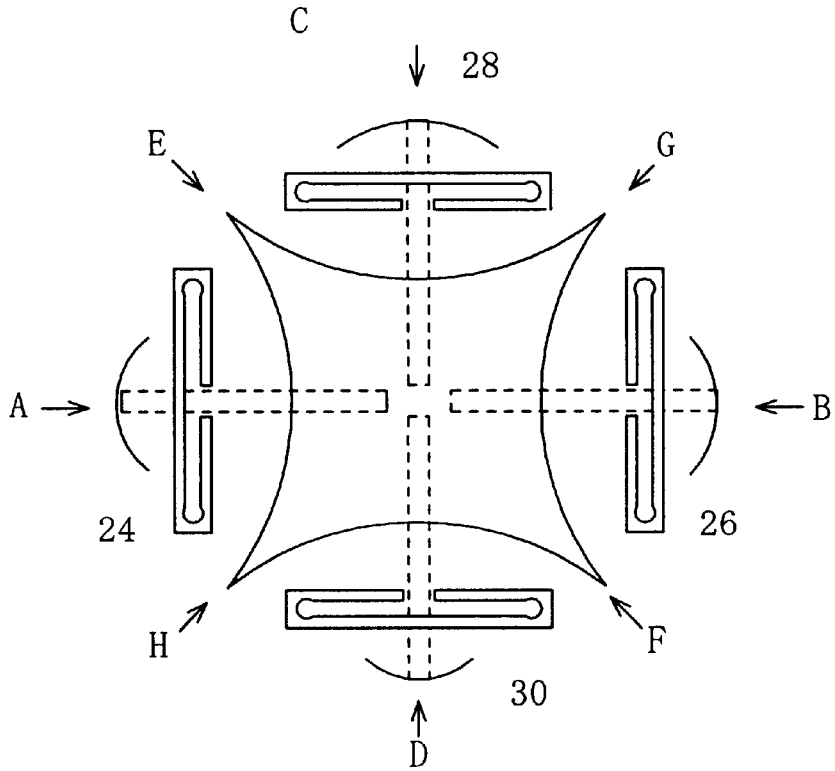
Figure 5:
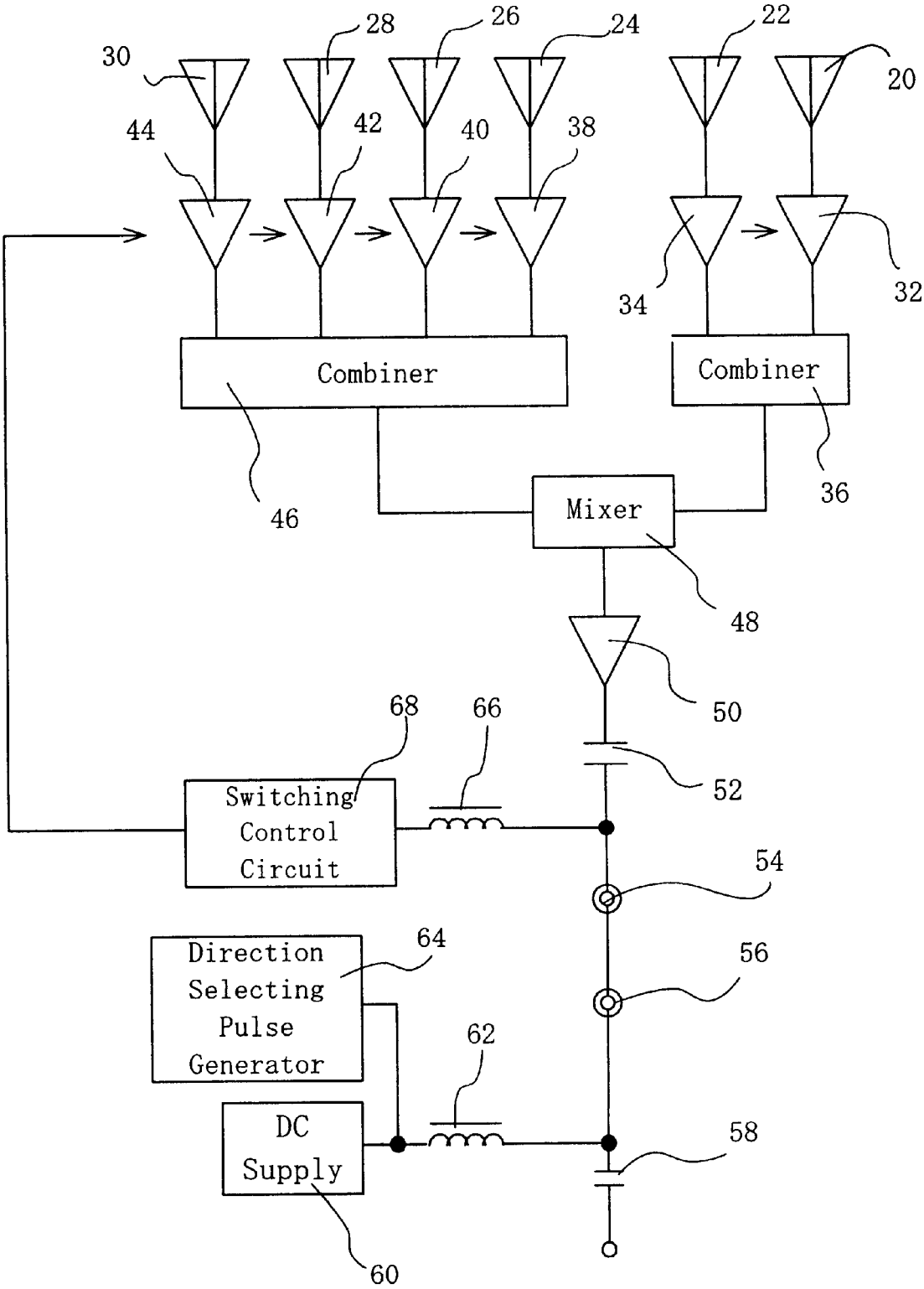
FIG. 5 is a block circuit diagram of the antenna system shown in FIG. 3.

An antenna system according to a second embodiment of the present invention is shown in FIGS. 3, 4 and 5. As shown in FIG. 3, the antenna system includes a plurality, e.g. two, of VHF receiving antennas 20 and 22, which are dipole antennas. The VHF receiving antenna 20 includes a pair of electrically conductive rod elements 20*a* and 20*b* arranged substantially in a line. The VHF receiving antenna 22 includes a pair of rod elements 22*a* and 22*b* arranged substantially in a line extending orthogonal to the line in which the rod elements 20*a* and 20*b* of the VHF receiving antenna 20 are arranged. The rod elements 20*a*, 20*b*, 22*a* and 22*b* radially extend outward and are angularly spaced one another by a predetermined angle, e.g. 90°. The two dipole antennas 20 and 22 form a cross dipole antenna. Although not shown, each of the dipole antennas 20 and 22 are individually fed at their respective inner or proximal ends through respective baluns from associated coaxial cables.

Four UHF receiving antennas 24, 26, 28 and 30 are mounted on the respective rod elements 20*a*, 20*b*, 22*a* and 22*b*. The UHF receiving antennas 24, 26, 28 and 30 have directors 24*a*, 26*a*, 28*a* and 30*a*, respectively, disposed on the distal end portions of the respective rod elements 20*a*, 20*b*, 22*a* and 22*b*.

Radiators 24*b*, 26*b*, 28*b* and 30*b* are disposed slightly inward of the respective directors 24*a*, 26*a*, 28*a* and 30*a*. The radiators 24*b*, 26*b*, 28*b* and 30*b* are in contact with the rod elements 20*a*, 20*b*, 22*a* and 22*b*. As the radiators 24*b*, 26*b*, 28*b* and 30*b*, folded dipoles are used for the same reasons as described for the first embodiment. The radiators 24*b*, 26*b*, 28*b* and 30*b* are planar in shape.

Reflectors 24*c*, 26*c*, 28*c* and 30*c* are disposed inward of the radiators 24*b*, 26*b*, 28*b* and 30*b*, respectively. The two ends of the respective ones of the reflectors 24*c*, 26*c*, 28*c* and 30*c* are in contact with the ends of the adjacent reflectors. For example, one end of the reflector 24*c* is in contact with one end of the adjacent reflector 28*c* with the other end contacting one end of the other adjacent reflector 30*c*. Since the ends of the reflectors 24*c*, 26*c*, 28*c* and 30*c* are in contact with the ends of adjacent reflectors, they are insulated from the rod elements 20*a*, 20*b*, 22*a* and 22*b* by insulators 23. If the reflectors do not contact with each other, the insulators 23 are not necessary. In some cases, the reflectors 24*c*, 26*c*, 28*c* and 30*c* may be eliminated.

Although not shown, the radiators 24*b*, 26*b*, 28*b* and 30*b* of the UHF receiving antennas 24, 26, 28 and 30 are fed through associated baluns from associated coaxial cables, as in the antenna system according to the first embodiment described above.

Since the UHF receiving antennas 24, 26, 28 and 30 are disposed on the rod elements of the VHF receiving antennas 20 and 22, they can be small in size. In addition, since the UHF receiving antennas 24, 26, 28 and 30 function as capacitance elements, the length of the rod elements 20*a*, 20*b*, 22*a* and 22*b* can be shorted than usually required, which further reduces the size of the antenna system as a whole.

The VHF receiving antenna 20 receives chiefly radio waves from directions a and b in FIG. 4A. Similarly, the VHF receiving antenna 22 receives chiefly waves from directions c and d. Radio waves coming from directions e, f, g and h can be derived by appropriately phase-adjusting and combining output signals of the VHF receiving antennas 20 and 22.

The UHF receiving antenna 24 receives chiefly radio waves from a direction A, as shown in FIG. 4B. The UHF receiving antenna 26 chiefly receives radio waves coming from a direction B. The UHF receiving antenna 28 receives chiefly radio waves from a direction C, and the UHF receiving antenna 30 chiefly receives radio waves from a direction D.

Radio waves from a direction E can be derived by appropriately phase-adjusting and combining outputs of the UHF receiving antennas 24 and 28. Radio waves from a direction F can be derived by appropriately phase-adjusting and combining outputs of the UHF receiving antennas 26 and 30. Radio waves from a direction H can be derived by appropriately phase-adjusting and combining outputs of the UHF receiving antennas 24 and 30. Radio waves from a direction G can be derived by appropriately phase-adjusting and combining outputs of the UHF receiving antennas 26 and 28.

Thus, radio waves in either of the VHF and UHF bands from any directions can be derived directly from or appropriately phase-adjusting and combining outputs of the VHF and UHF receiving antennas. In other words, although the individual antennas used are directional antennas, the resulting antenna system has directional response approximating to that of a non-directional antenna. When the antenna system is used to receive television broadcast waves, ghost is reduced relative to the use of non-direction antennas.

For this purpose, as shown in FIG. 5, the outputs of the VHF receiving antennas 20 and 22 are amplified in amplifiers 32 and 34, respectively, and are combined in a combining circuit 36. Similarly, the outputs of the UHF receiving antennas 24, 26, 28 and 30 are amplified in amplifiers 38, 30, 42 and 44, respectively, and are combined in a combining circuit 46. Outputs from the combining circuits 36 and 46 are mixed in a mixer 48, and an output of the mixer 48 is amplified in an amplifier 50. The amplifier output is then applied through a DC blocking capacitor 52 and an output terminal 54 to an input terminal 56 in a room or on a moving body, e.g. on a vehicle. Then, the signal applied to the input terminal 56 is applied to a television receiver (not shown) through a DC blocking capacitor 58.

Within the room or on the moving body, a DC power supply 60 for supplying an operating voltage to the above-described circuits including the amplifiers 32, 34, 38, 40, 42, 44 and 50, which are installed outdoors. The DC voltage from the DC power supply 60 is applied to the output terminal 54 through a high-frequency blocking coil 62 and the input terminal 56, and then applied to the amplifiers 32, 34, 38, 40, 42, 44 and 50 through associated high-frequency blocking coils (not shown).

Selecting means 64, e.g. a receiving direction selecting pulse generator, is also arranged in the room or on the moving body. Receiving direction selecting pulses generated by the receiving direction selecting pulse generator 64 are applied through the high-frequency blocking coil 62, the input terminal 56, the output terminal 54 and a high-frequency blocking coil 66 to a switching control circuit 68.

Although not shown, the receiving direction selecting pulse generator 64 has a VHF band direction switch and an UHF band direction switch. The UHF band direction switch has switch contacts corresponding to the directions A through H shown in FIG. 4B, and a contacting member which can contact any one of the switch contacts. The receiving direction selecting pulse generator 64 generates a pulse signal corresponding to the switch contact with which the contacting member is brought into contact.

The switching control circuit 68, when receiving the pulse signal, selects one or two of the outputs of the amplifiers 38, 40, 42 and 44 so that radio waves from the direction indicated by the applied pulse signal can be derived, and applies the output or outputs to the combining circuit 46. The VHF band direction switch is similarly arranged.

Figure 6:
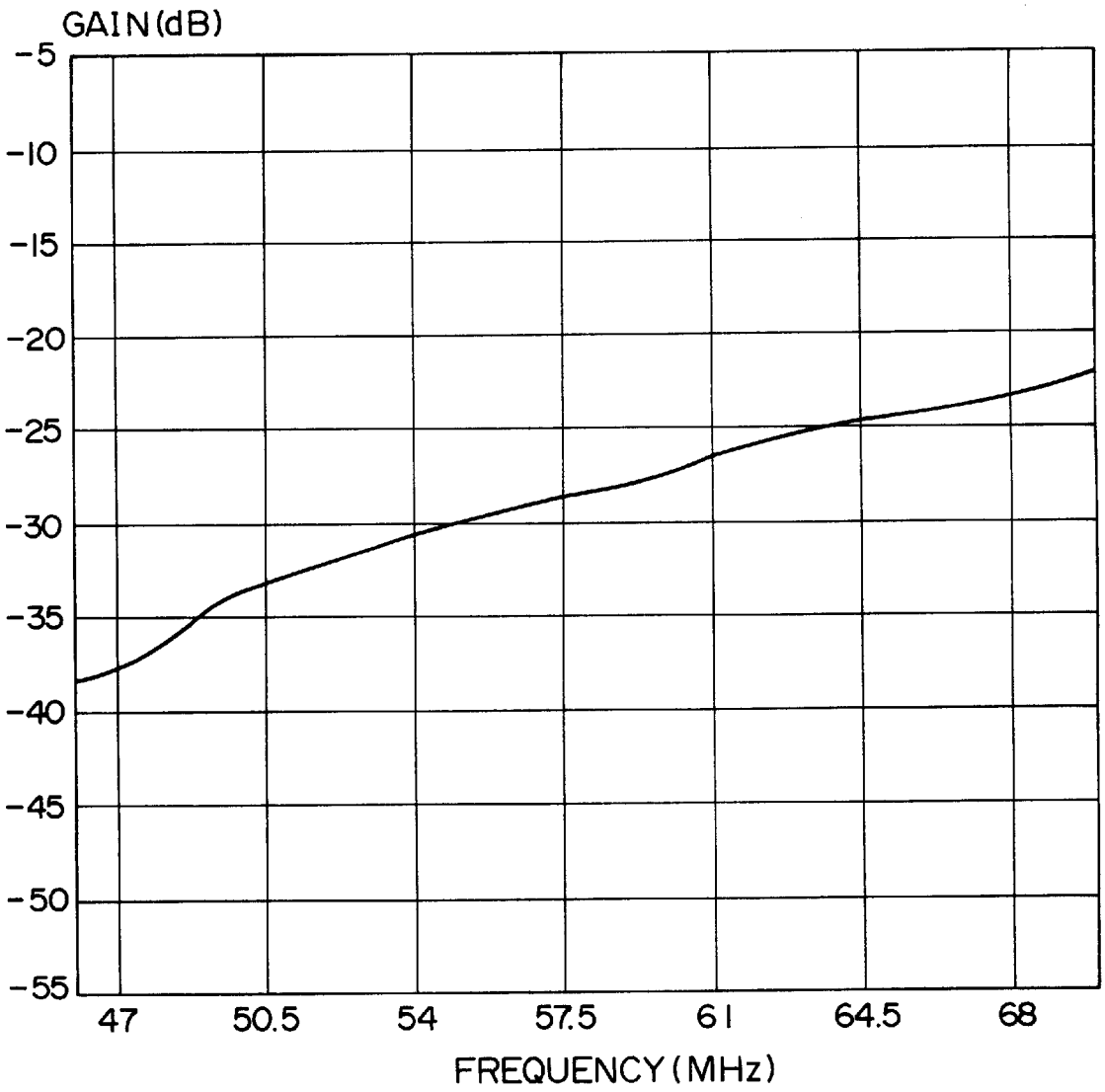
FIG. 6 shows the gain-versus-frequency characteristic of the antenna system shown in FIGS. 3–5 in a frequency range of from about 47 MHz to about 68 MHz, in which only one of the VHF band antennas is utilized.
Figure 7:
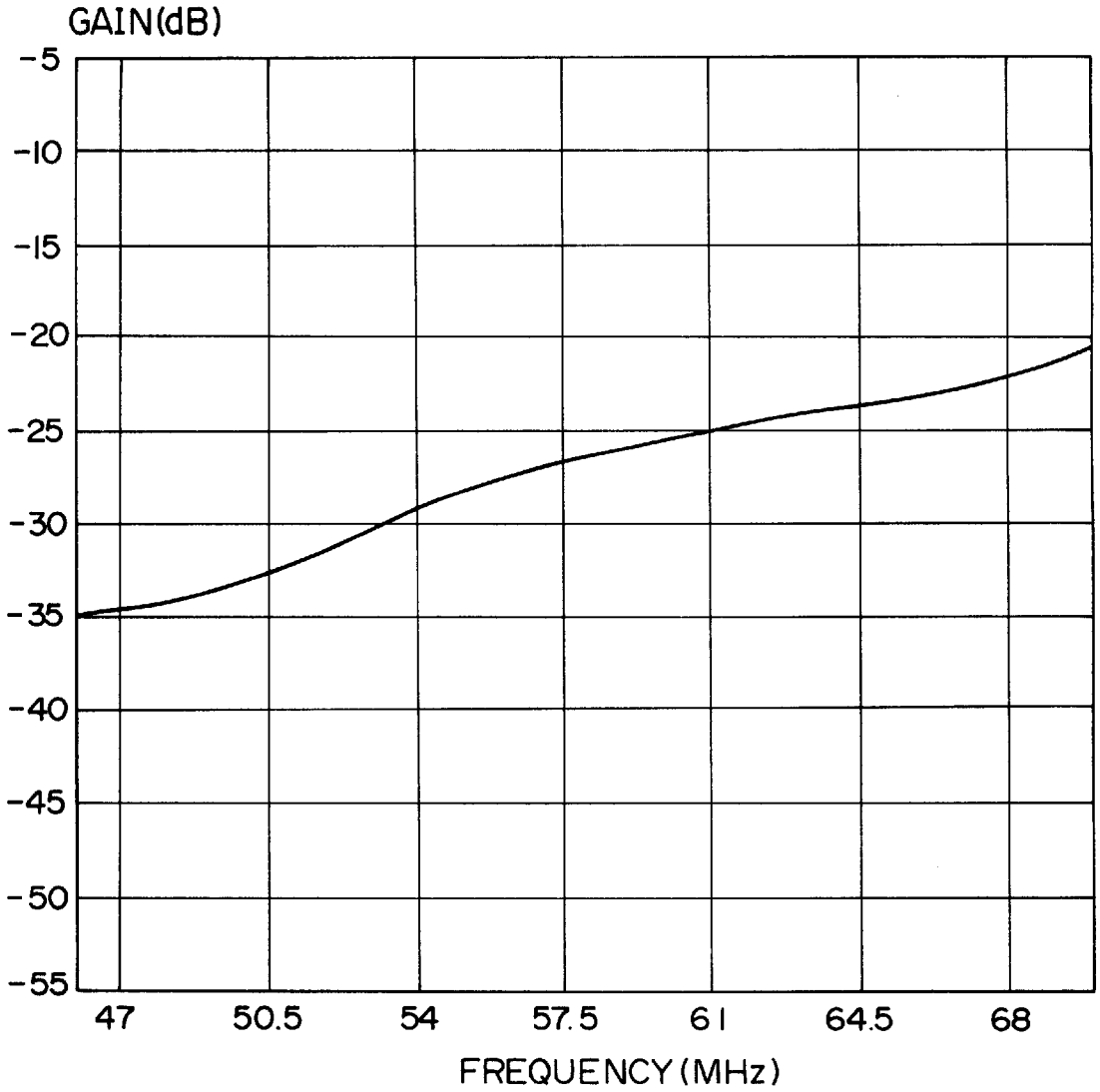
FIG. 7 shows the composite gain-versus-frequency characteristic of the antenna system shown in FIGS. 3–5 in a frequency range of from about 47 MHz to about 68 MHz, resulting from combining the gain-versus-frequency characteristics of the two VHF band antennas.

FIGS. 6 and 7 show the gain-versus-frequency characteristics in the VHF band exhibited by the antenna system shown in FIGS. 3–5, in a frequency range of from about 47 MHz to about 68 MHz. FIG. 6 is the characteristic when the output of one of the two VHF receiving antennas is derived, while FIG. 7 is the characteristic resulting from combining the outputs of the two VHF receiving antennas.

Figure 8:
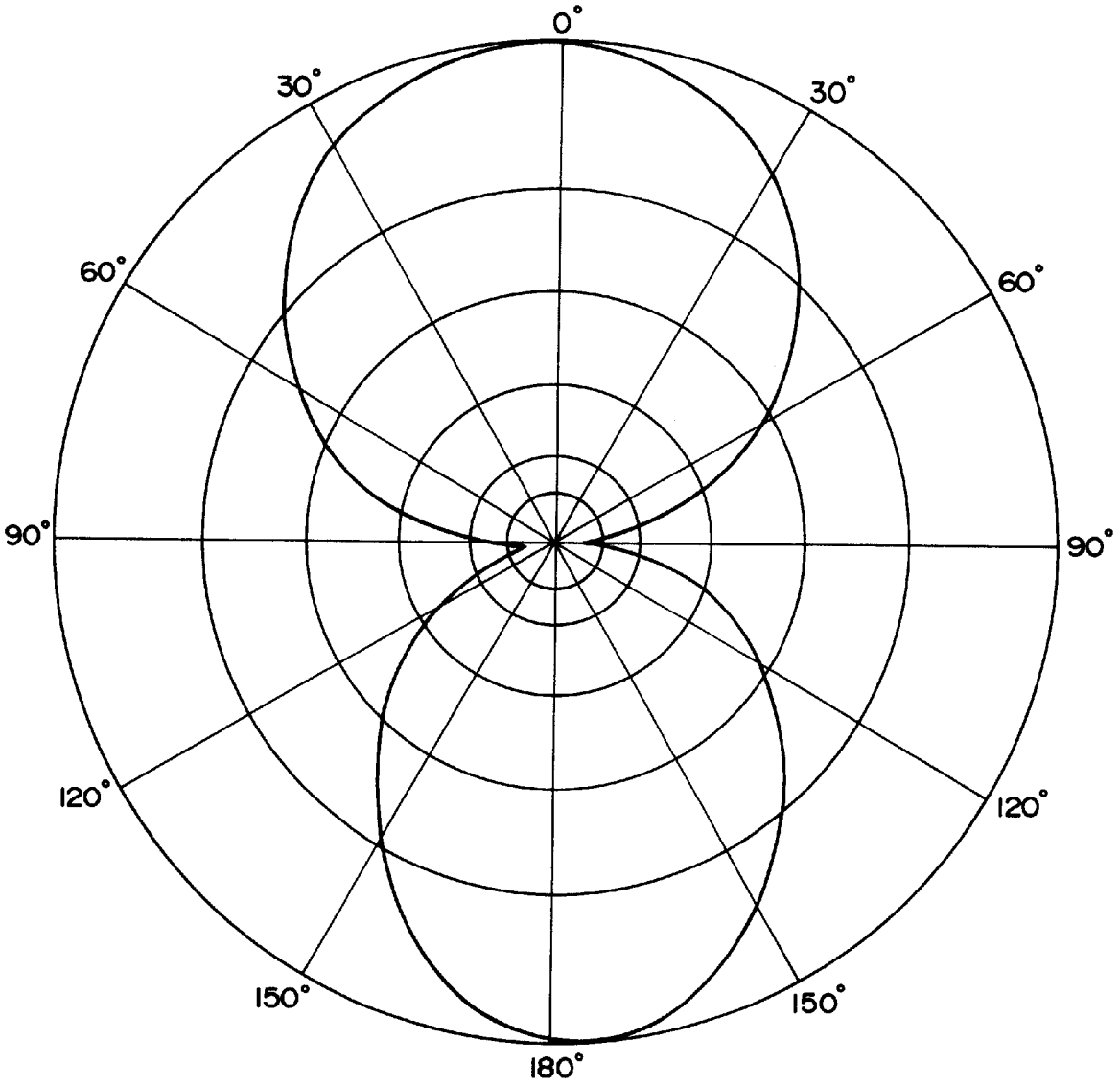
FIG. 8 shows the directional response characteristic of the antenna system shown in FIGS. 3–5 at a frequency within a frequency range of from about 47 MHz to about 68 MHz, in which only one of the two VHF band receiving antennas is utilized.
Figure 9:
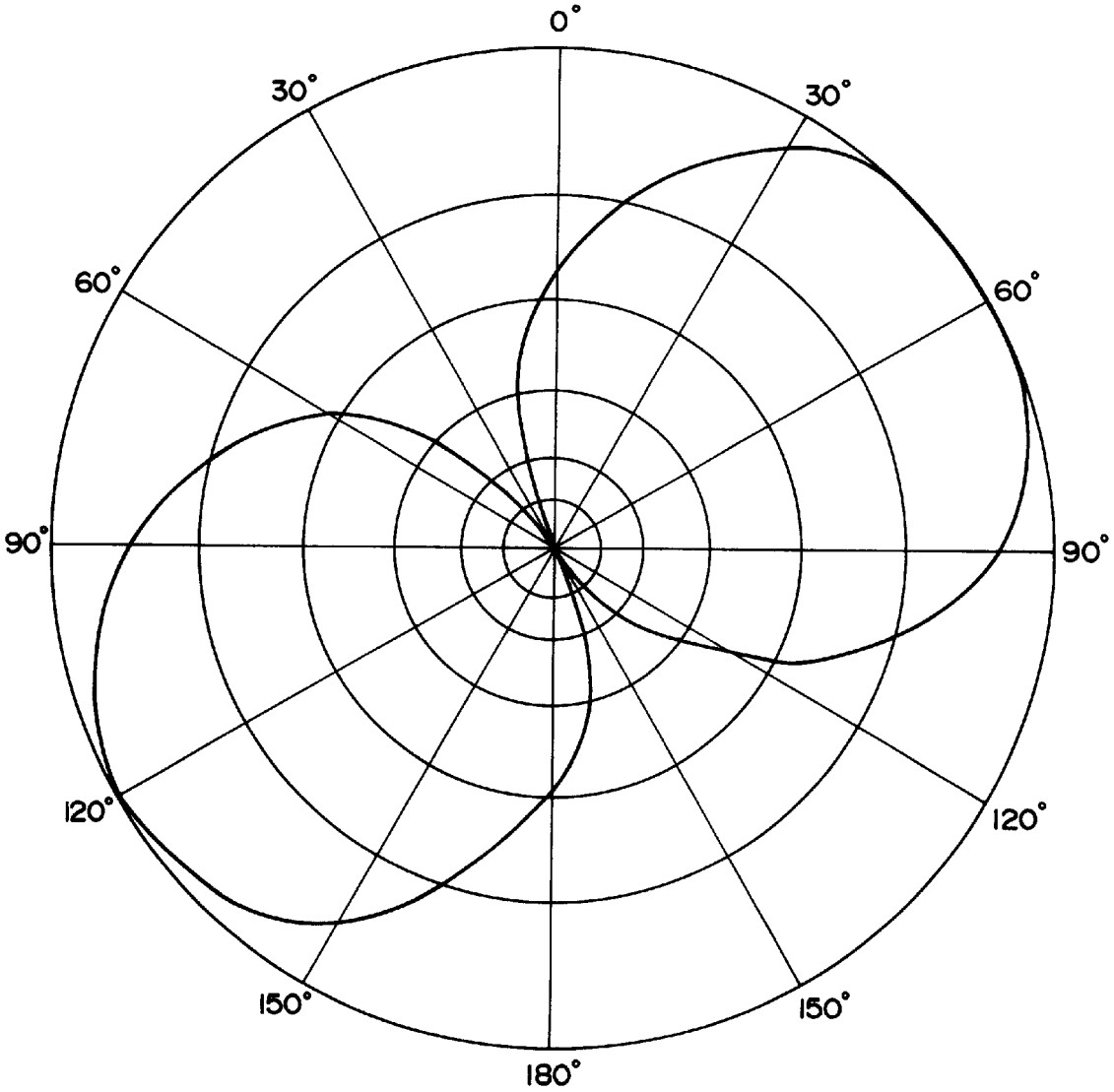
FIG. 9 shows the combined directional response characteristic of the antenna system shown in FIGS. 3–5at a frequency within a frequency range of from about 47 MHz to about 68 MHz, which results from combining the directional response characteristics of both VHF band receiving antennas.

FIGS. 8 and 9 are directional response patterns of the antenna system at a frequency within a frequency range of from about 47 MHz to about 68 MHz. FIG. 8 shows the directional response pattern when one of the two VHF receiving antennas is used, while FIG. 9 shows the directional response pattern resulting from combining the outputs of the two VHF receiving antennas. FIG. 9 clearly shows that the directional response of the antenna system changes as a result of the combining of outputs.

Figure 10:
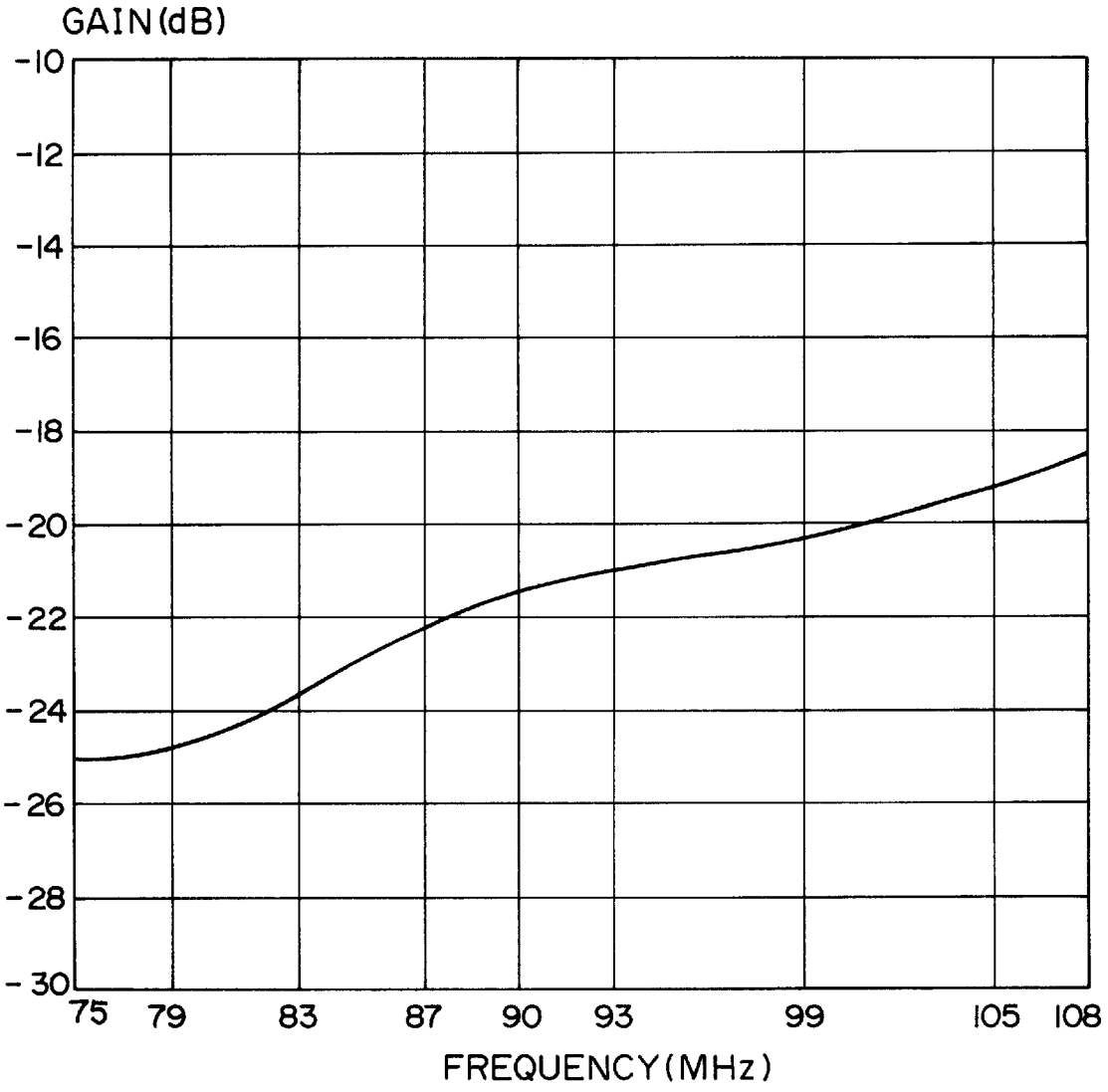
FIG. 10 shows the gain-versus-frequency characteristic of the antenna system shown in FIGS. 3–5 in a frequency range of from about 75 MHz to about 108 MHz when only one of the VHF band antennas is utilized.
Figure 11:
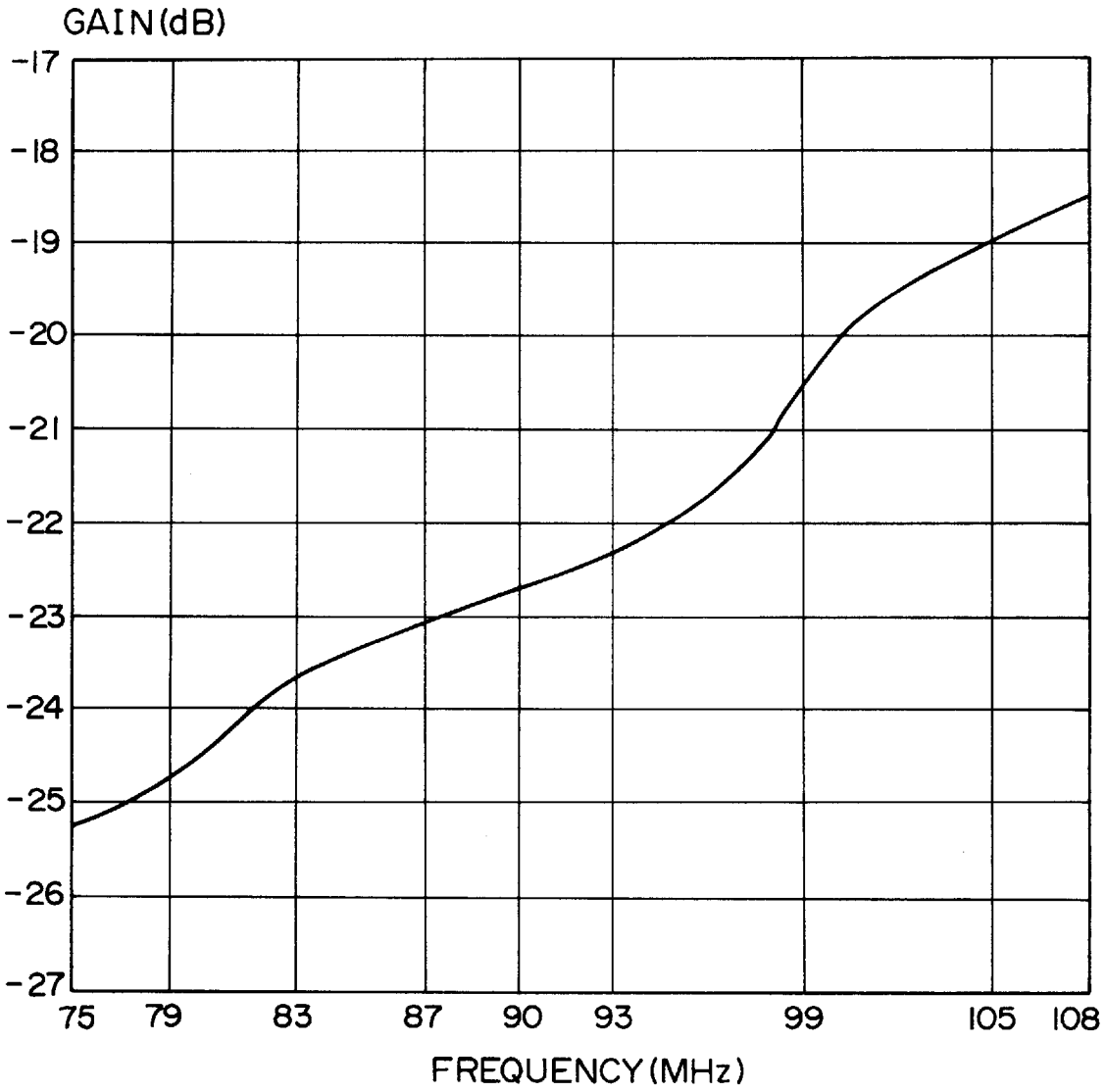
FIG. 11 shows the composite gain-versus-frequency characteristic of the antenna system shown in FIGS. 3–5 in a frequency range of from about 75 MHz to about 108 MHz, resulting from combining the gain-versus-frequency characteristics of the two VHF band antennas.

FIGS. 10 and 11 show gain-versus-frequency characteristics in the VHF band of the antenna system shown in FIGS. 3–5 in a frequency range of from about 75 MHz to about 108 MHz, in which FIG. 10 is the gain-versus-frequency characteristic when one of the two VHF receiving antennas is used, and FIG. 11 is the gain-versus-frequency characteristic resulting from combining the outputs of the two VHF receiving antennas.

Figure 12:
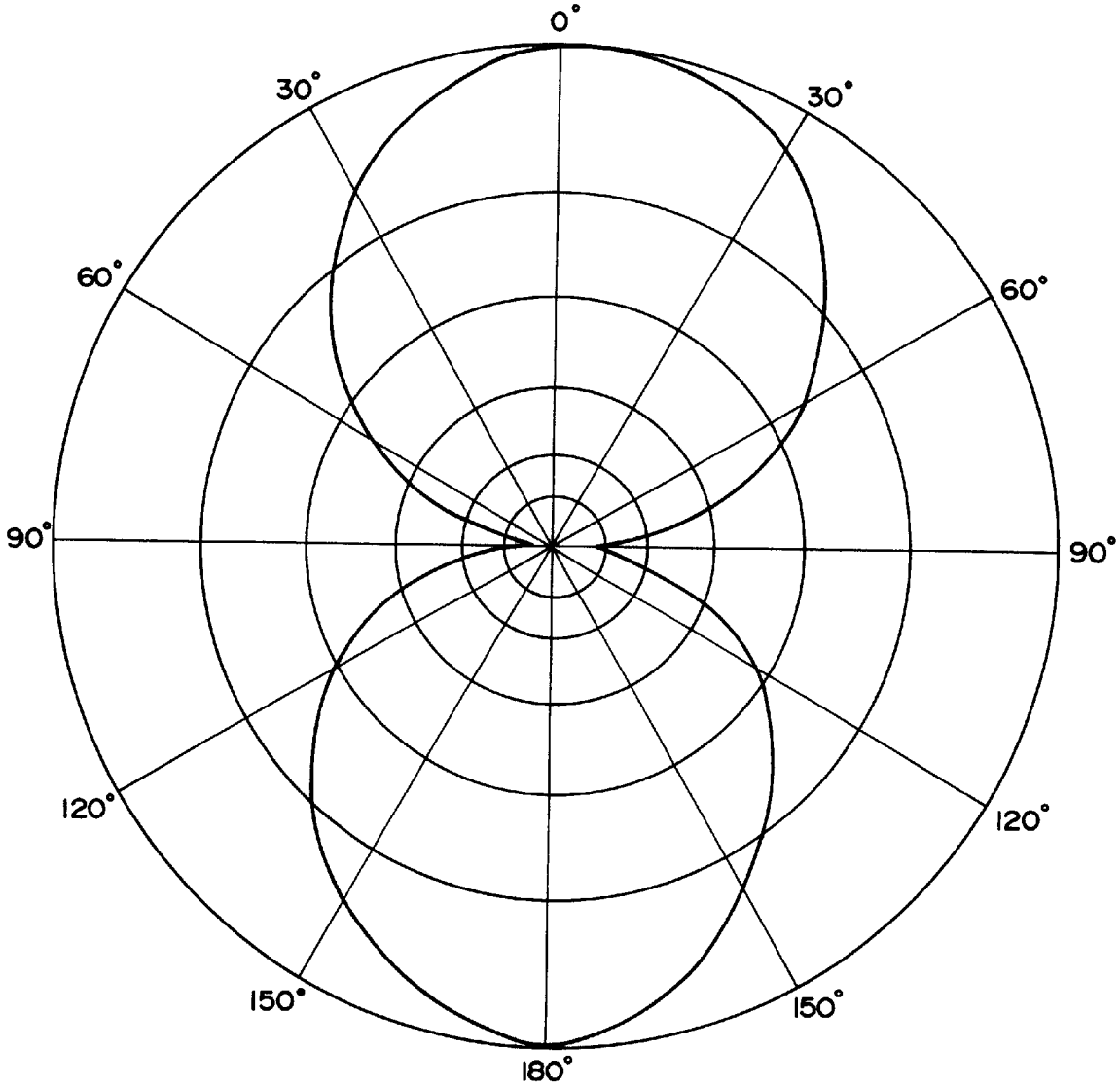
FIG. 12 shows the directional response of the antenna system shown in FIGS. 3–5 at a frequency within a frequency range of from about 75 MHz to about 108 MHz when only one of the two VHF band receiving antennas is utilized.
Figure 13:
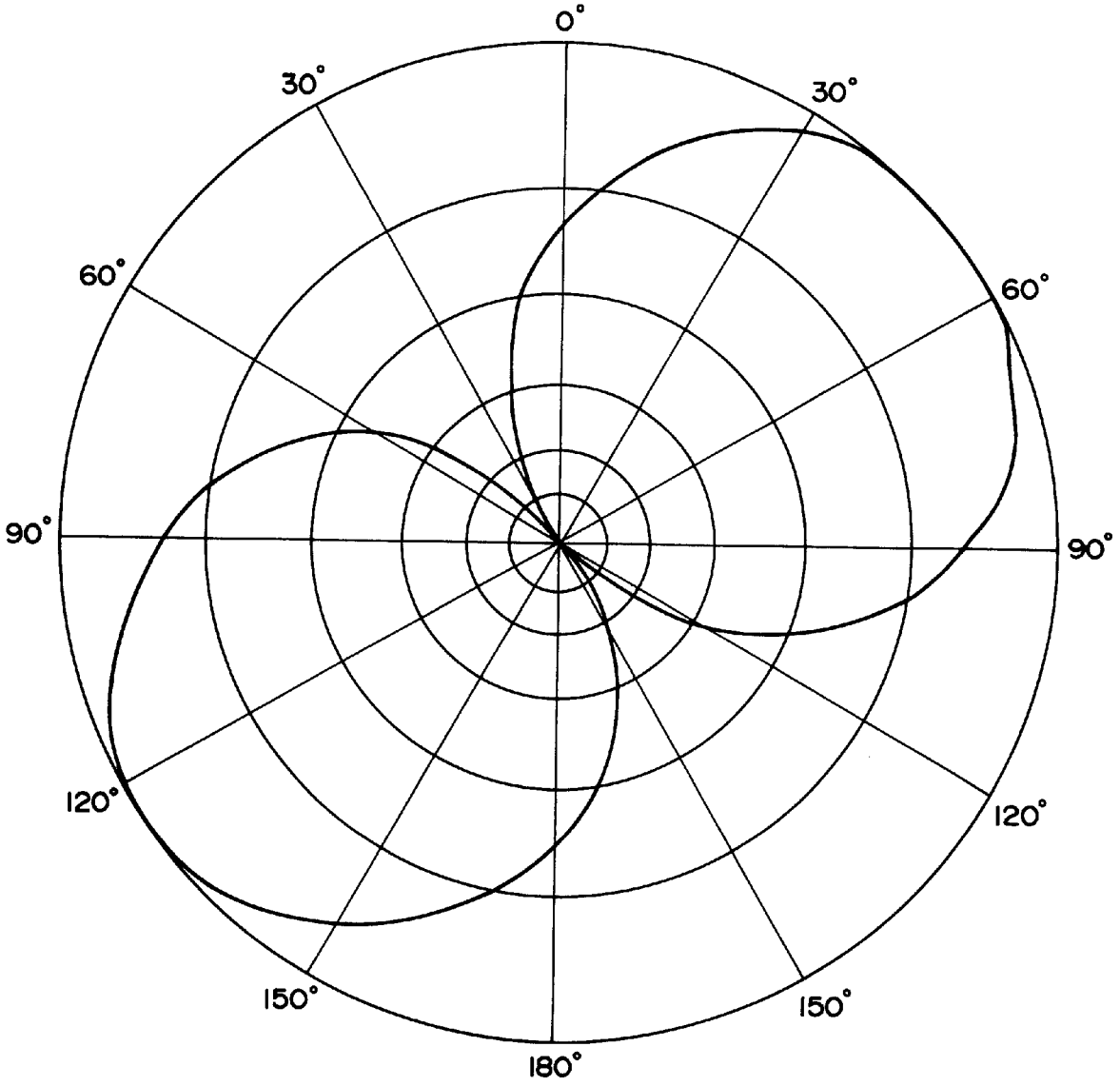
FIG. 13 shows the combined directional response of the antenna system shown in FIGS. 3–5 at a frequency within a frequency range of from about 75 MHz to about 108 MHz, resulting from combining the directional response characteristics of the two VHF band receiving antennas.

FIGS. 12 and 13 are directional response patterns of the antenna system at a frequency within a frequency range of from about 75 MHz to about 108 MHz. FIG. 12 shows the directional response pattern when one of the two VHF receiving antennas is used, while FIG. 13 shows the directional response pattern resulting from combining the outputs of the two VHF receiving antennas. FIG. 13 clearly shows that the directional response of the antenna system changes as a result of the combining of outputs.

Figure 14:
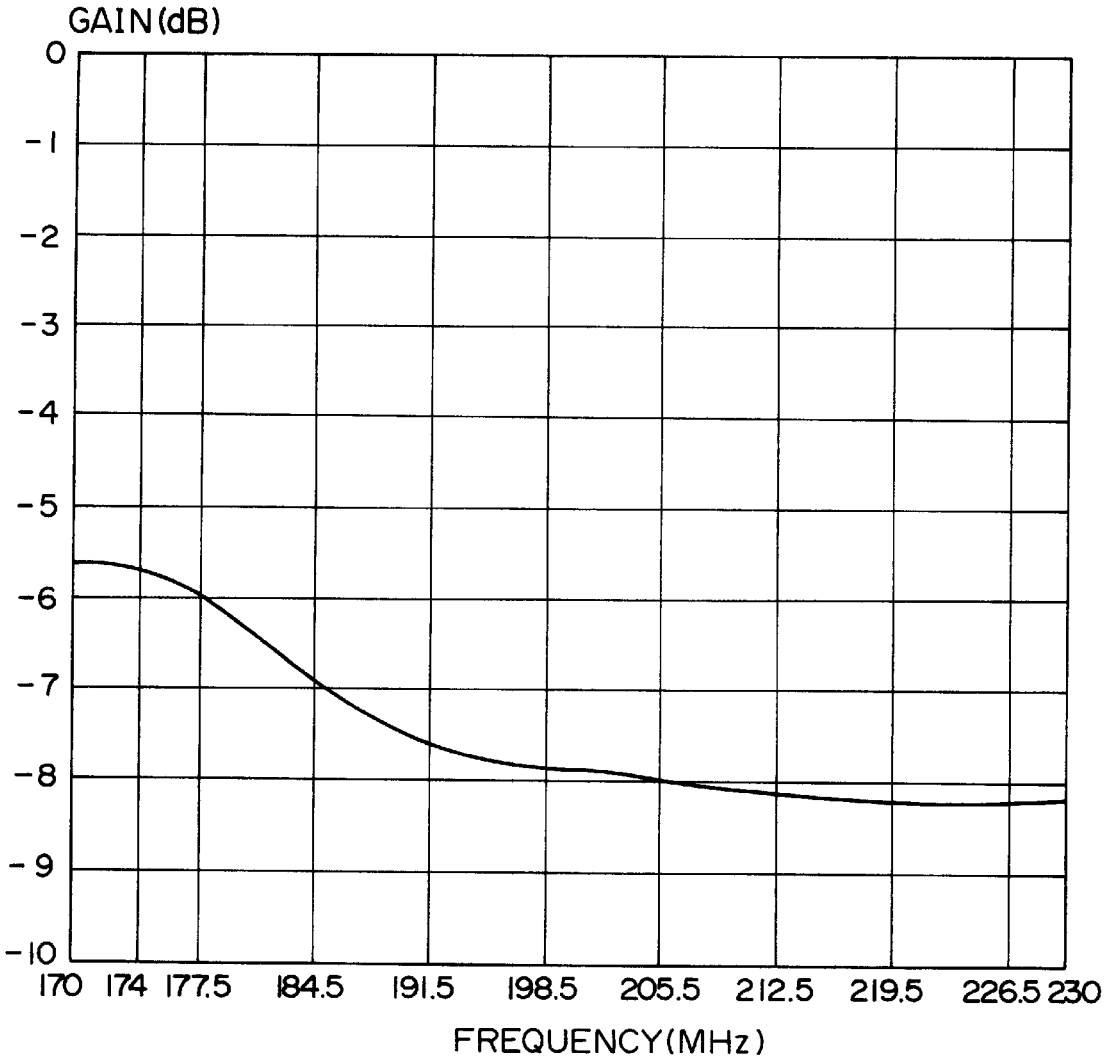
FIG. 14 shows the gain-versus-frequency characteristic of the antenna system shown in FIGS. 3–5 in a frequency range of from about 170 MHz to about 230 MHz, when only one of the two VHF band antennas is utilized.
Figure 15:
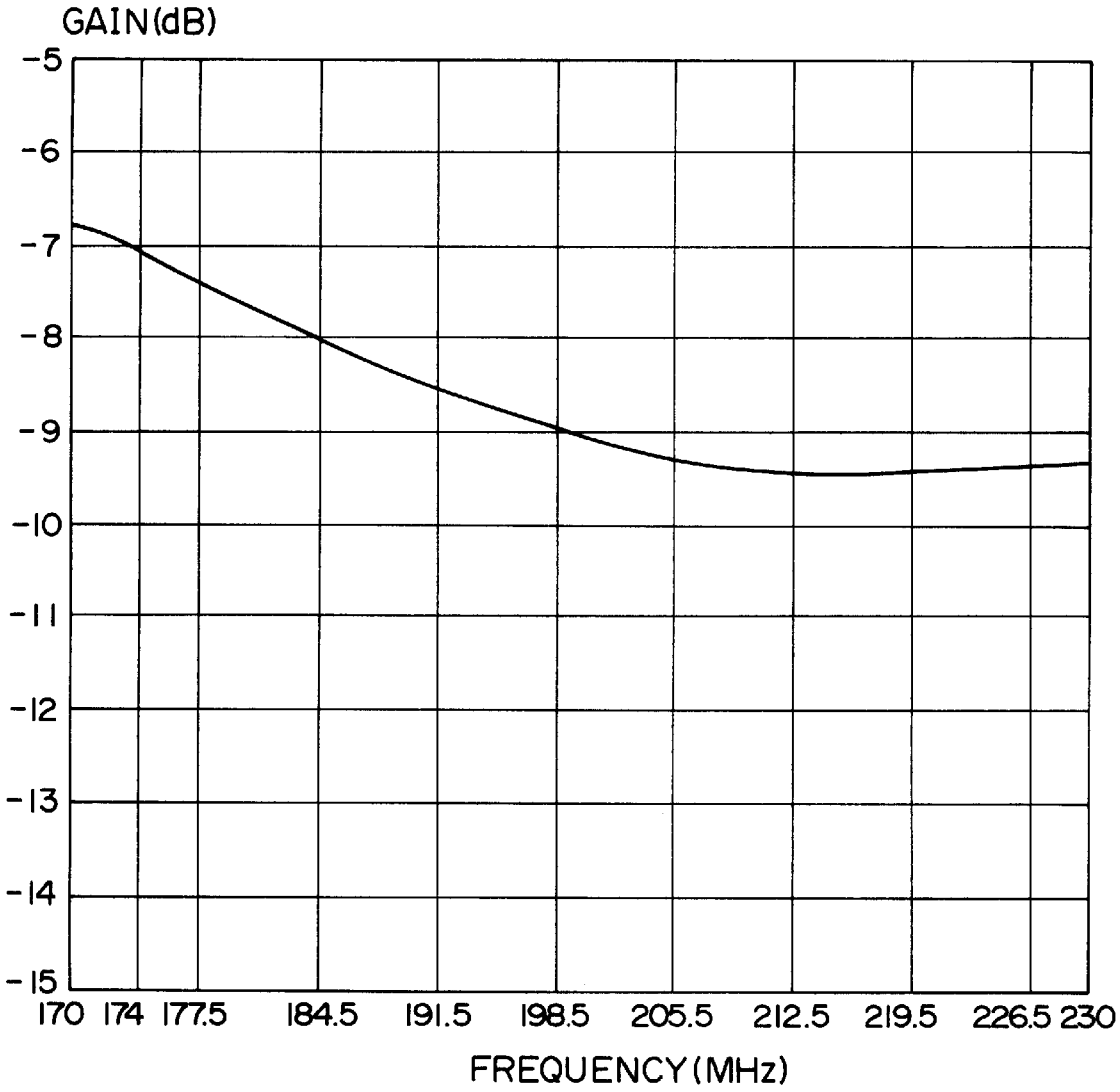
FIG. 15 shows the composite gain-versus-frequency characteristic of the antenna system shown in FIGS. 3–5 in a frequency range of from about 170 MHz to about 230 MHz, resulting from combining the gain-versus-frequency characteristics of the two VHF band antennas.

FIGS. 14 and 15 show gain-versus-frequency characteristics in the VHF band of the antenna system shown in FIGS. 3–5 in a frequency range of from about 170 MHz to about 230 MHz, in which FIG. 14 is the gain-versus-frequency characteristic when one of the two VHF receiving antennas is used, and FIG. 15 is the gain-versus-frequency characteristic resulting from combining the outputs of the two VHF receiving antennas.

Figure 16:
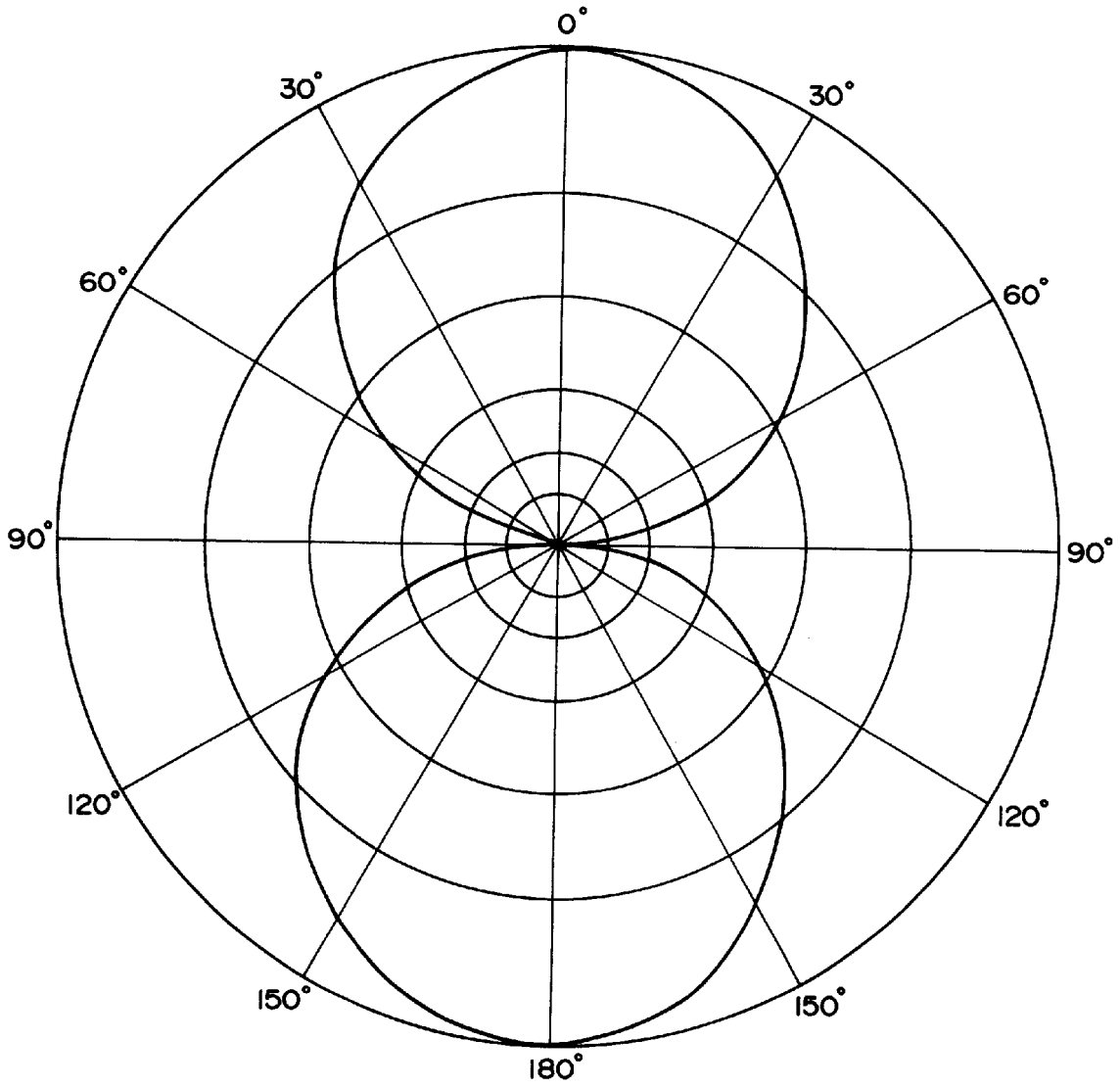
FIG. 16 shows the directional response of the antenna system shown in FIGS. 3–5 at a frequency within a frequency range of from about 170 MHz to about 230 MHz, when only one of the two VHF band receiving antennas is utilized.
Figure 17:
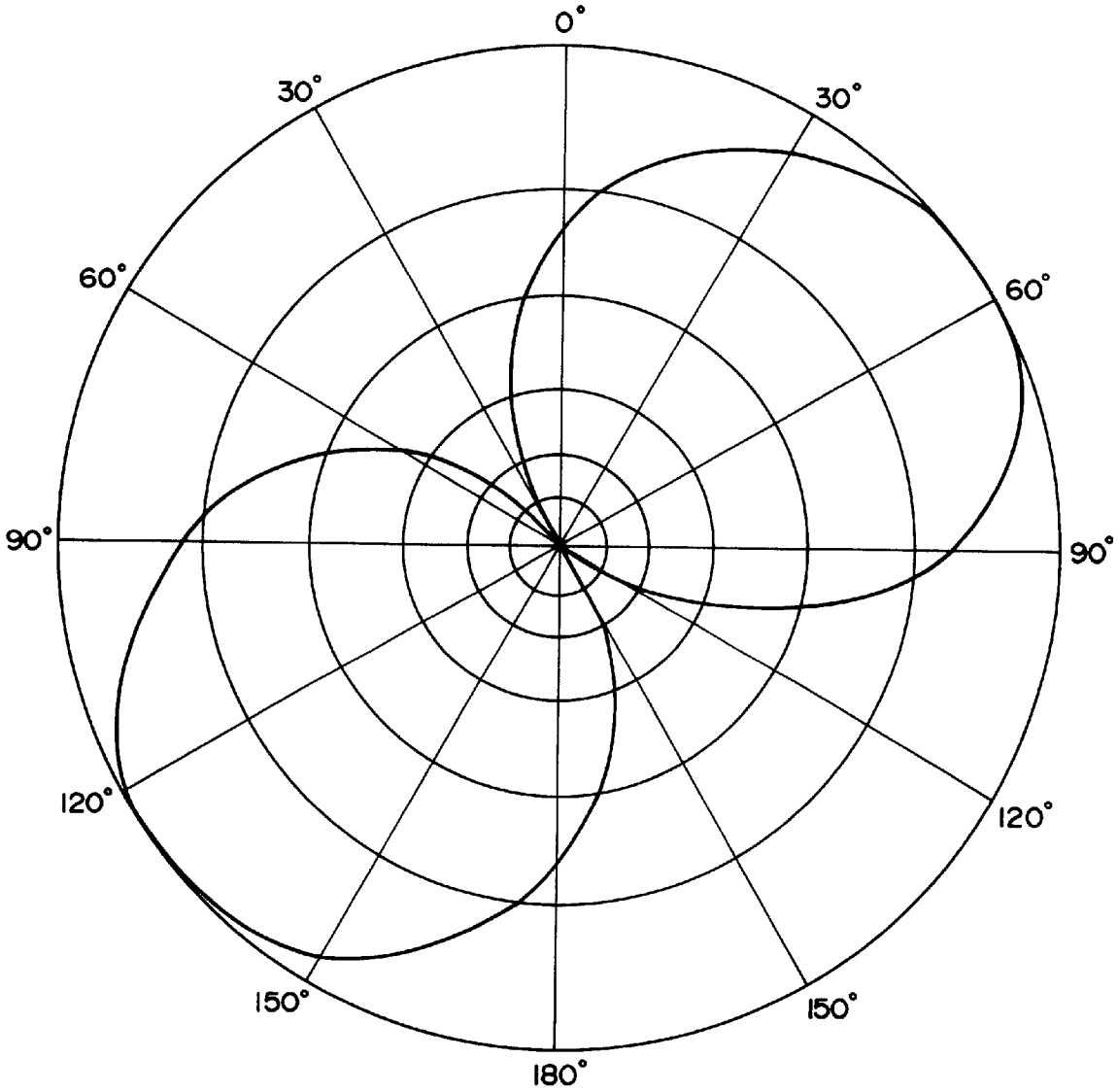
FIG. 17 shows the combined directional response of the antenna system shown in FIGS. 3–5 at a frequency within a frequency range of from about 170 MHz to about 230 MHz, resulting from combining the directional responses of the two VHF band receiving antennas.

FIGS. 16 and 17 are directional response patterns of the antenna system at a frequency within a frequency range of from about 170 MHz to about 230 MHz. FIG. 16 shows the directional response pattern when one of the two VHF receiving antennas is used, while FIG. 17 shows the directional response pattern resulting from combining the outputs of the two VHF receiving antennas. FIG. 17 clearly shows that the directional response of the antenna system changes as a result of the combining of outputs.

Figure 18:
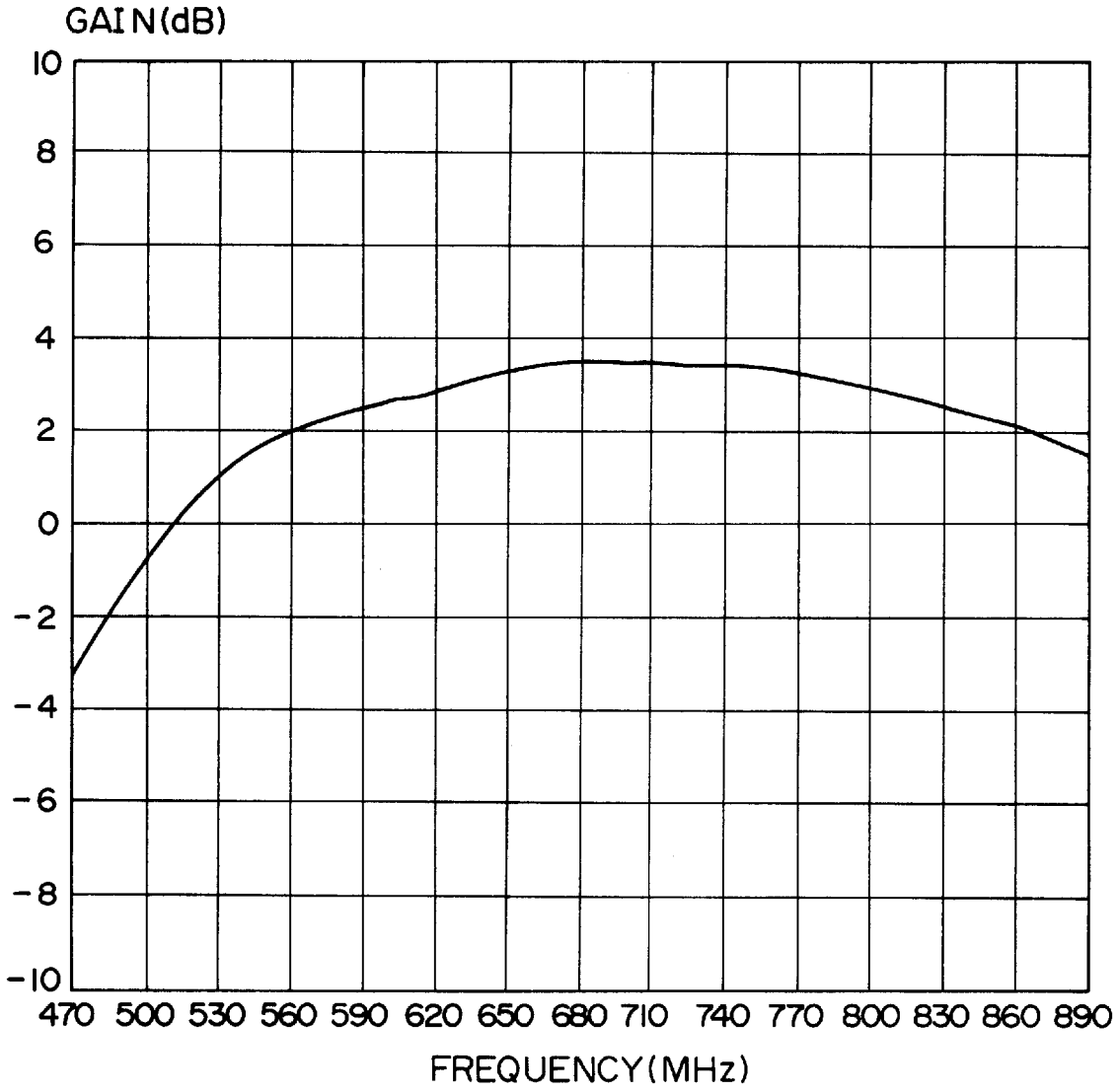
FIG. 18 shows the gain-versus-frequency characteristic of the antenna system shown in FIGS. 3–5 in a frequency range of from about 470 MHz to about 890 MHz, when only one of four UHF band antennas is used.

FIG. 18 shows a gain-versus-frequency characteristic of the antenna system shown in FIGS. 3–5 in a frequency range of from about 470 MHz to about 890 MHz, in which one of four UHF receiving antennas is utilized.

Figure 19:
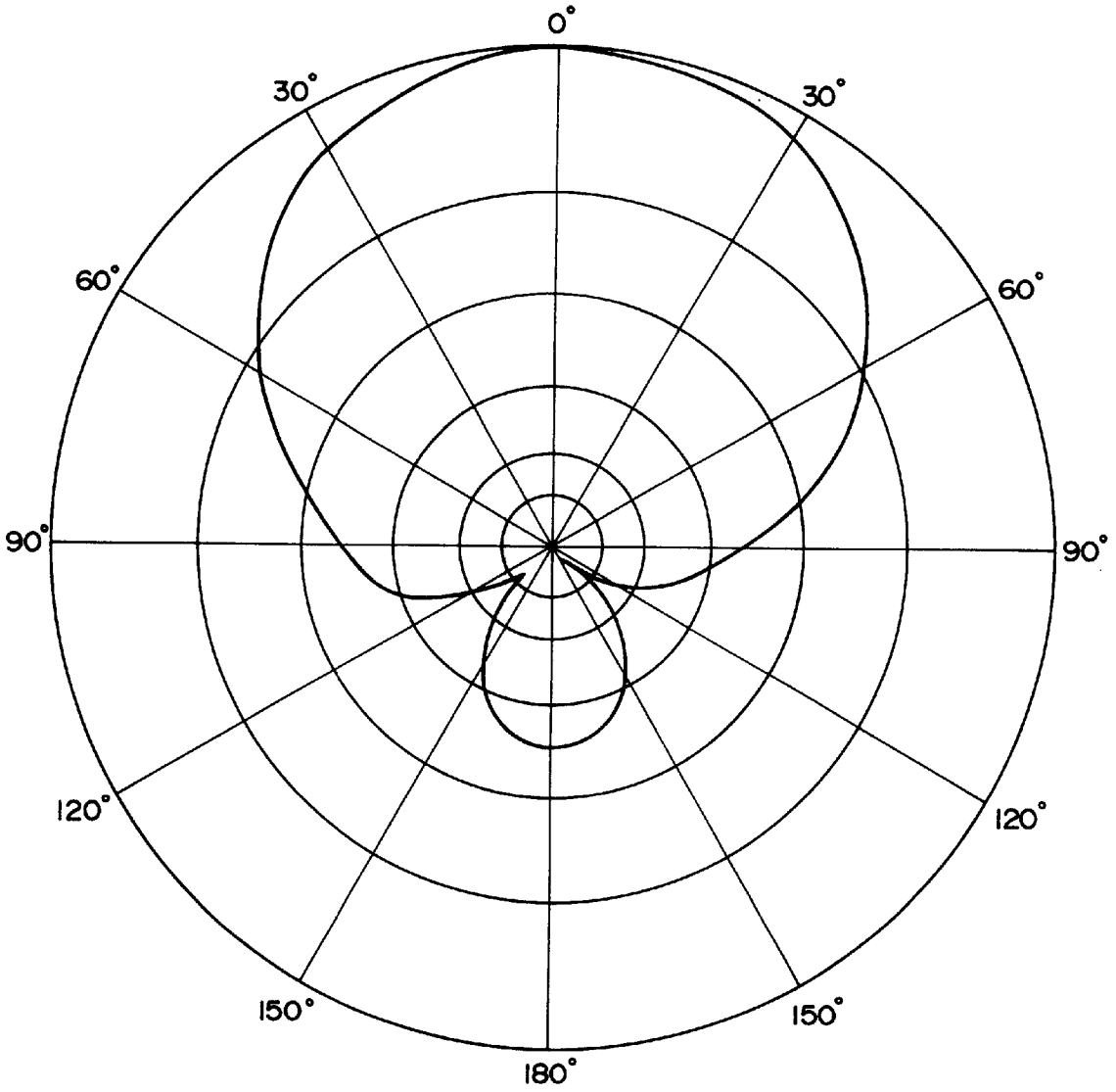
FIG. 19 shows the directional response of the antenna system shown in FIGS. 3–5 at a frequency within a frequency range of from about 470 MHz to about 890 MHz, in which only one of the four UHF band receiving antennas is used.

FIG. 19 is a directional response pattern of the antenna system at a frequency within a frequency range of from about 470 MHz to about 890 MHz, in which one of the four UHF receiving antennas is utilized.

Figure 34:
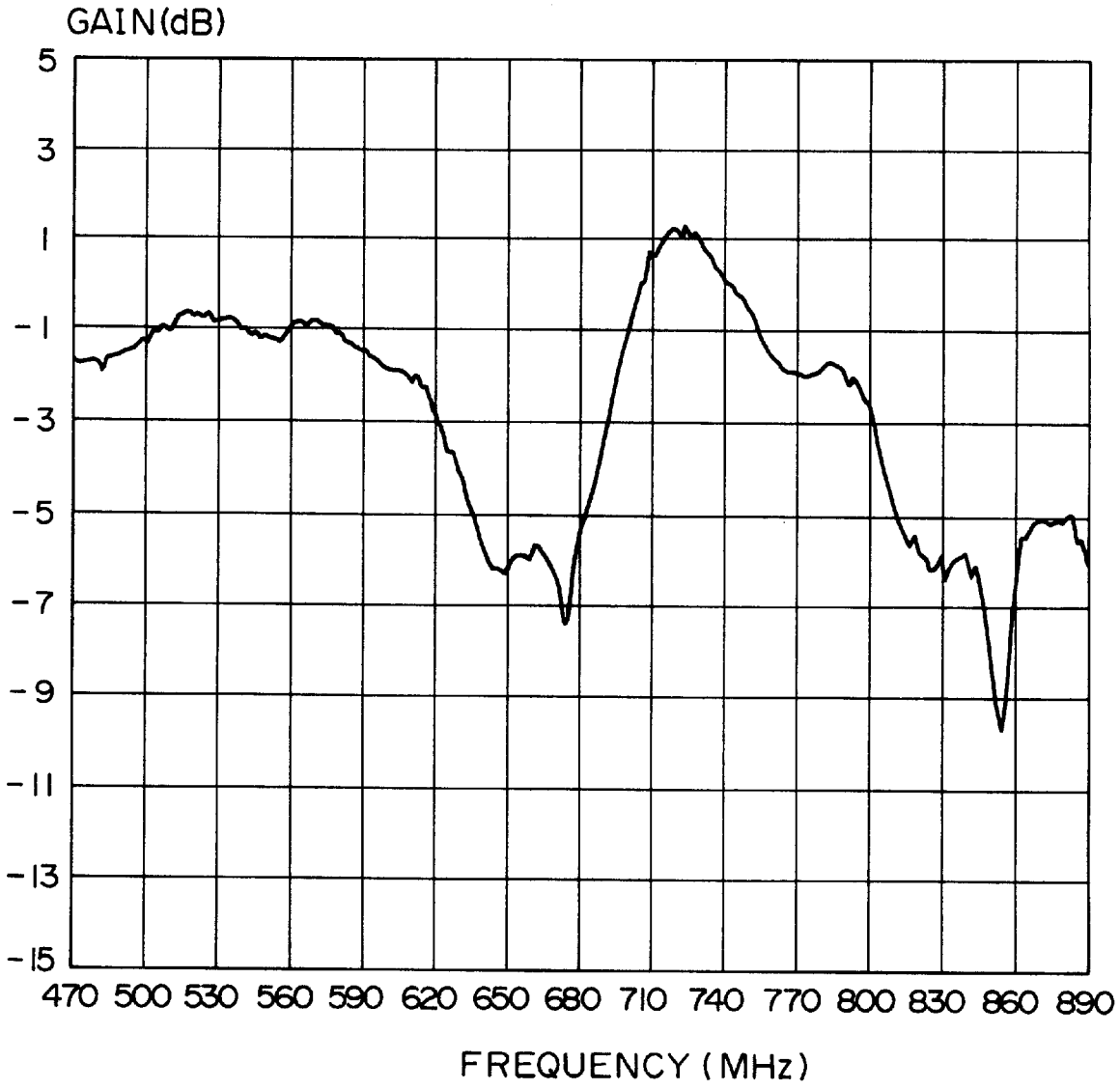
FIG. 34 shows the composite gain-versus-frequency characteristic of the antenna system shown in FIGS. 3–5 in a frequency range of from about 470 MHz to about 890 MHz, in which two of the four UHF antennas are utilized, resulting from combining the gain-versus-frequency characteristics of the two UHF band antennas.

Also, FIG. 34 shows a gain-versus-frequency characteristic of the antenna system shown in FIGS. 3–5 in a frequency range of from about 470 MHz to about 890 MHz, in which two of the four UHF receiving antennas are utilized. This gain-versus-frequency characteristic results from combining the gain-versus-frequency characteristics of the two individual UHF receiving antennas together.

Figure 35:
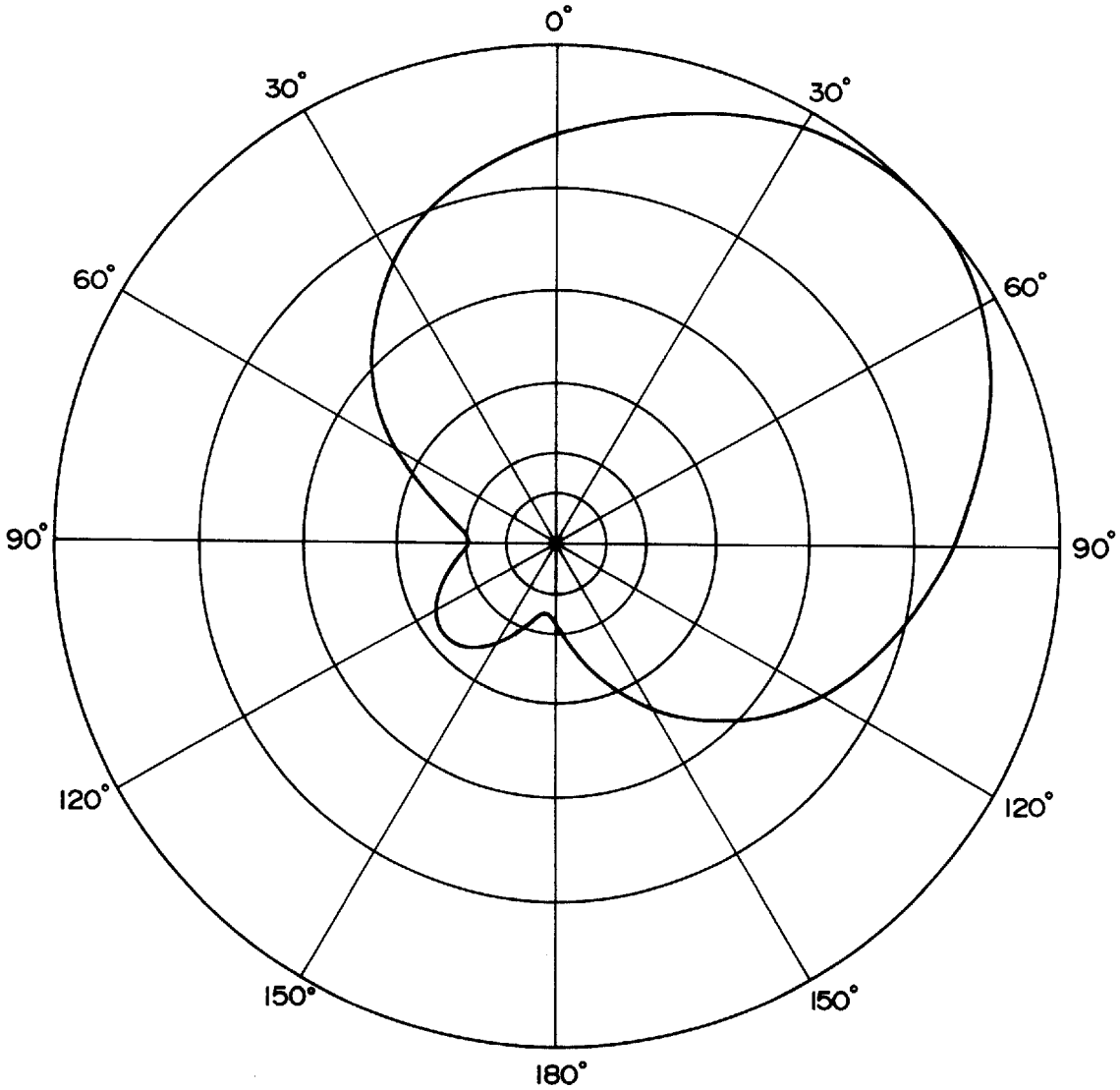
FIG. 35 shows the combined directional response of the antenna system shown in FIGS. 3–5 at a frequency within a frequency range of from about 470 MHz to about 890 MHz, in which two of the four UHF band receiving antennas are utilized, resulting from combining the directional responses of the two UHF antennas.

FIG. 35 shows a combined directional response pattern of two UHF band receiving antennas of the antenna system shown in FIGS. 3–5 at a frequency within a frequency range of from about 470 MHz to about 890 MHz, in which the two UHF receiving antennas are utilized. This directional response results from combining the directional responses of the two individual UHF antennas together.

Figure 20:
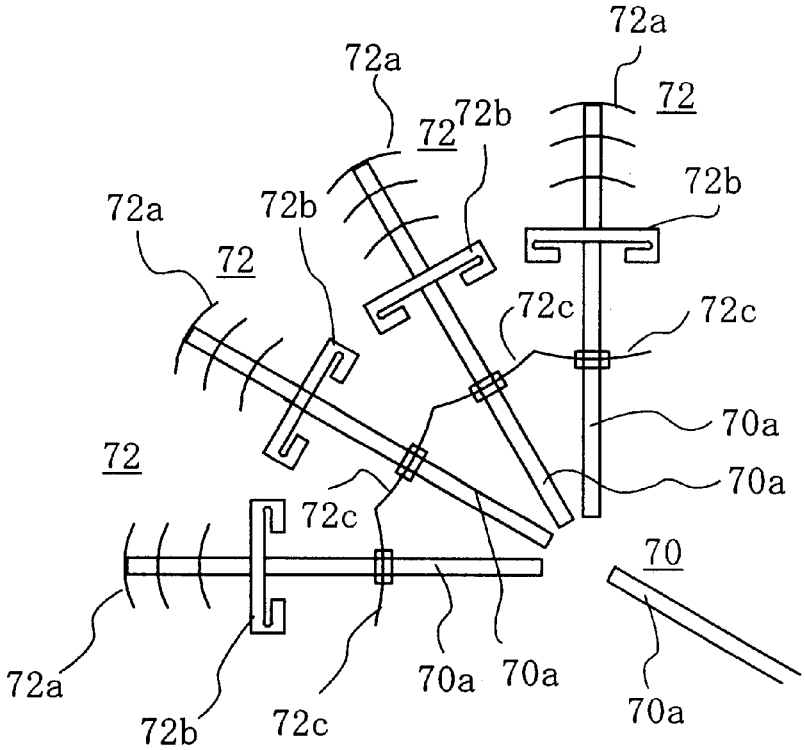
FIG. 20 is a plan view of an antenna system according to a third embodiment of the present invention.

FIG. 20 shows an antenna system according to a third embodiment of the present invention. The antenna system according to the second embodiment described above used orthogonally disposed two dipole antennas as VHF receiving antennas, and, therefore, the number of UHF receiving antennas which can be disposed on the rod elements of the VHF receiving antennas is limited to four. Accordingly, according to the second embodiment, each of the UHF receiving antennas must have a relatively broad directional response, and, therefore, improvement of the gain may not be expected.

According to the third embodiment, a plurality of VHF receiving dipole antennas 70 include respective rod elements 70*a*, which are radially arranged, being angularly spaced from the rod elements 70*a* of adjacent dipole antennas 70 by an angle less than 90°.

In the distal or outer end portions of the respective rod elements 70*a*, UHF receiving Yagi antennas 72 are disposed. Each of the Yagi antennas 72 includes a director 72*a*, a radiator 72*b* and a reflector 72*c*, as the UHF receiving antennas of the antenna system according to the above-described second embodiment. The radiator 72*b* is a planar, folded dipole antenna.

By the use of a plurality of directors 72*a*, each of the UHF receiving antennas can have a narrow directional response and a high gain. Although not shown, a switching control circuit and a receiving direction selecting pulse generator as used in the second embodiment are used to switch the directional response. The reflectors 72*c* may be eliminated.

Thus, the size of the antenna system according to the third embodiment, too, can be small.

Figure 21:
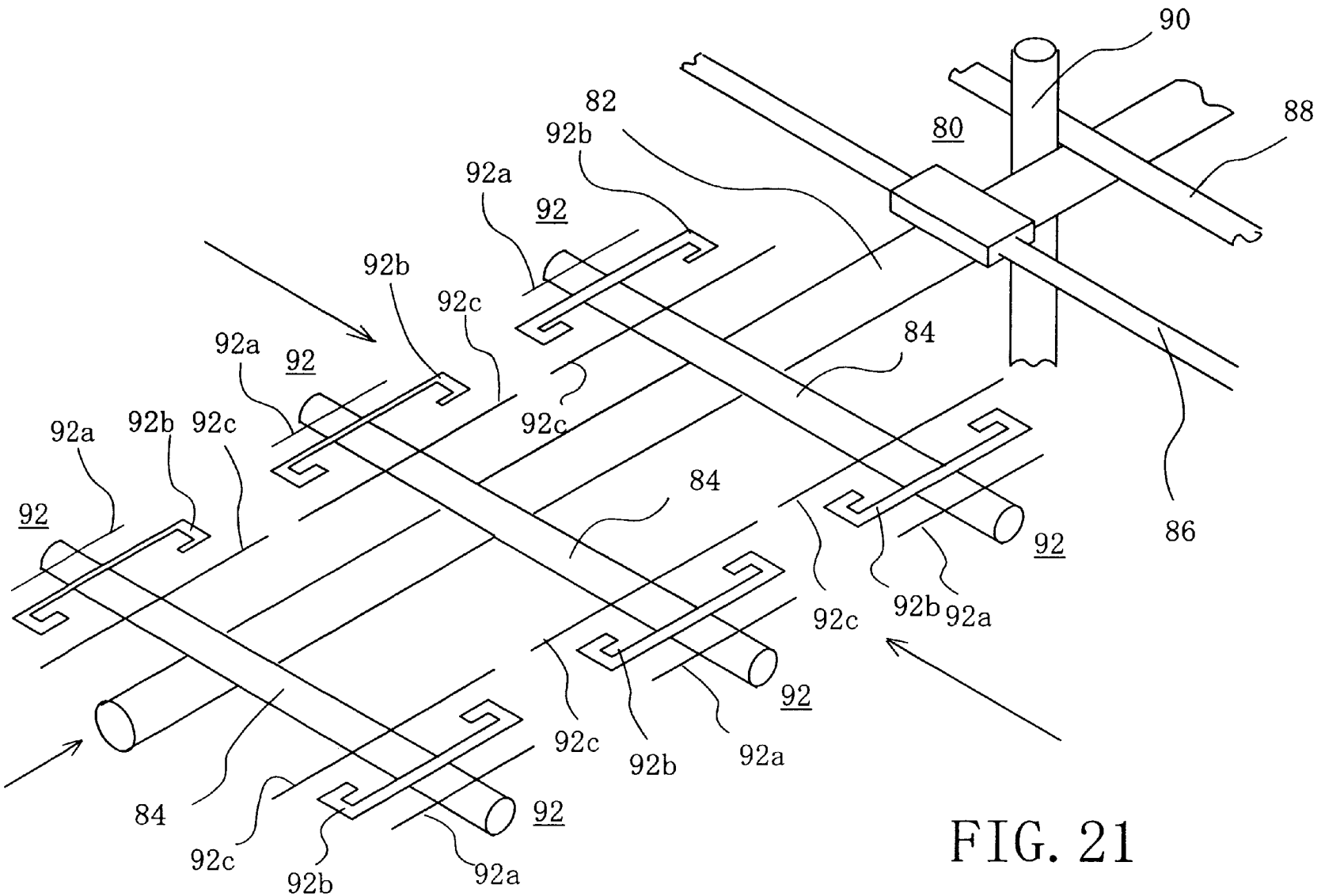
FIG. 21 is a plan view of an antenna system according to a fourth embodiment of the present invention.

An antenna system according to a fourth embodiment of the present invention is shown in FIG. 21. The antenna system shown in FIG. 21 includes a VHF receiving Yagi antenna 80. The Yagi antenna 80 is an ordinary Yagi antenna having a support boom 82, on which a plurality, e.g. three, of directors 84, one radiator 86 and one reflector 88. The boom 82 is supported on a post 90.

On each of the three directors 84, two UHF receiving Yagi antennas 92 are disposed. Each of the Yagi antenna 92 includes a director 92*a* disposed in the outer side of the antenna 92, a radiator 92*b* which is a planar folded dipole disposed inward of the director 92*a*, and a reflector 92*c* disposed inward of the radiator 92*b*. The radiator 92*b* is electrically isolated from the director 84 of the VHF receiving Yagi antenna 80.

The UHF receiving Yagi antennas 92 can be used as a diversity reception antenna because they are spaced from one another by a fixed distance along the support boom 82 and exhibit a greater directional response to radio waves coming from the directions indicated by arrows shown on the opposite sides of the boom 82. The VHF receiving antenna 80 is adapted to receive radio waves coming from the direction toward the directors 84 along the support boom 82 as indicated by an arrow shown adjacent to the distal end of the support boom 82. As the antenna systems of the first through third embodiments, the antenna system according to the fourth embodiment can be small in size, too.

In the antenna systems according to the first through fourth embodiments, the radiator of the UHF receiving antenna is disposed in direct contact with the rod element of the VHF receiving antenna. This is for reducing the length of the rod element. Accordingly, if the rod element of an ordinary length can be used, the radiator of the UHF antenna is mounted on the rod element of the VHF antenna with an insulator interposed between them.

Figure 22:
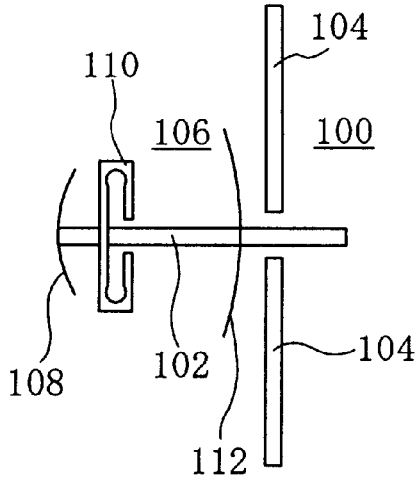
FIG. 22 is a plan view of an antenna system according to a fifth embodiment of the present invention.

An antenna system according to a fifth embodiment of the present invention is shown in FIG. 22. The UHF receiving antennas of the antenna system according to the fourth embodiment are disposed on the directors of the VHF receiving antenna, and, therefore, their directional responses are maximum in the direction generally perpendicular to that of the VHF receiving antenna. The directional responses in the VHF and UHF bands of the antenna system according to the fifth embodiment are maximum substantially in the same direction.

The antenna system shown in FIG. 22 includes a VHF receiving antenna 100, which has radiators 104 attached to a support boom 102. The radiators 104 are rod elements disposed substantially in a line, as shown. A UHF receiving antenna 106 is disposed on a distal end portion of the boom 102 opposite to the radiators 104. The UHF receiving antenna 106 has a director 108 disposed at the distal end of the boom 102 in such a manner as to be generally in parallel with the radiators 104. The UHF antenna 106 has a radiator 110 disposed on the boom 102 inward of the director 108. As in the antenna systems of the embodiments described above, the radiator 110, too, is a planar folded dipole, which is generally parallel with the radiators 104 of the VHF antenna 100. The mid-portion of the radiator 110 is in contact with the boom 102. Inward of the radiator 110 and outward of the radiators 104 of the VHF antenna 100, a reflector 112 of the UHF receiving antenna 106 is disposed generally in parallel with the radiators 104. The dimensions and locations of the director 108, radiator 110 and reflector 112 of the UHF receiving antenna 106 are determined such that the UHF receiving antenna can function also as a director for the VHF receiving antenna 100.

With the above-described arrangement, the antenna system can efficiently receive both UHF and VHF radio waves coming from the same direction. In addition, since the UHF antenna 106 functions as the director for the VHF antenna 100, the gain in the VHF band can be improved. In some cases, the director 108 and the reflector 112 can be eliminated. Alternatively, the number of the directors 108 may be increased.

According to this embodiment, too, the antenna system can be small in size because the boom 102 is used in common to the VHF and UHF antennas.

An antenna system according to a sixth embodiment of the present invention is described with reference to FIGS. 23–33H.

Figure 23:
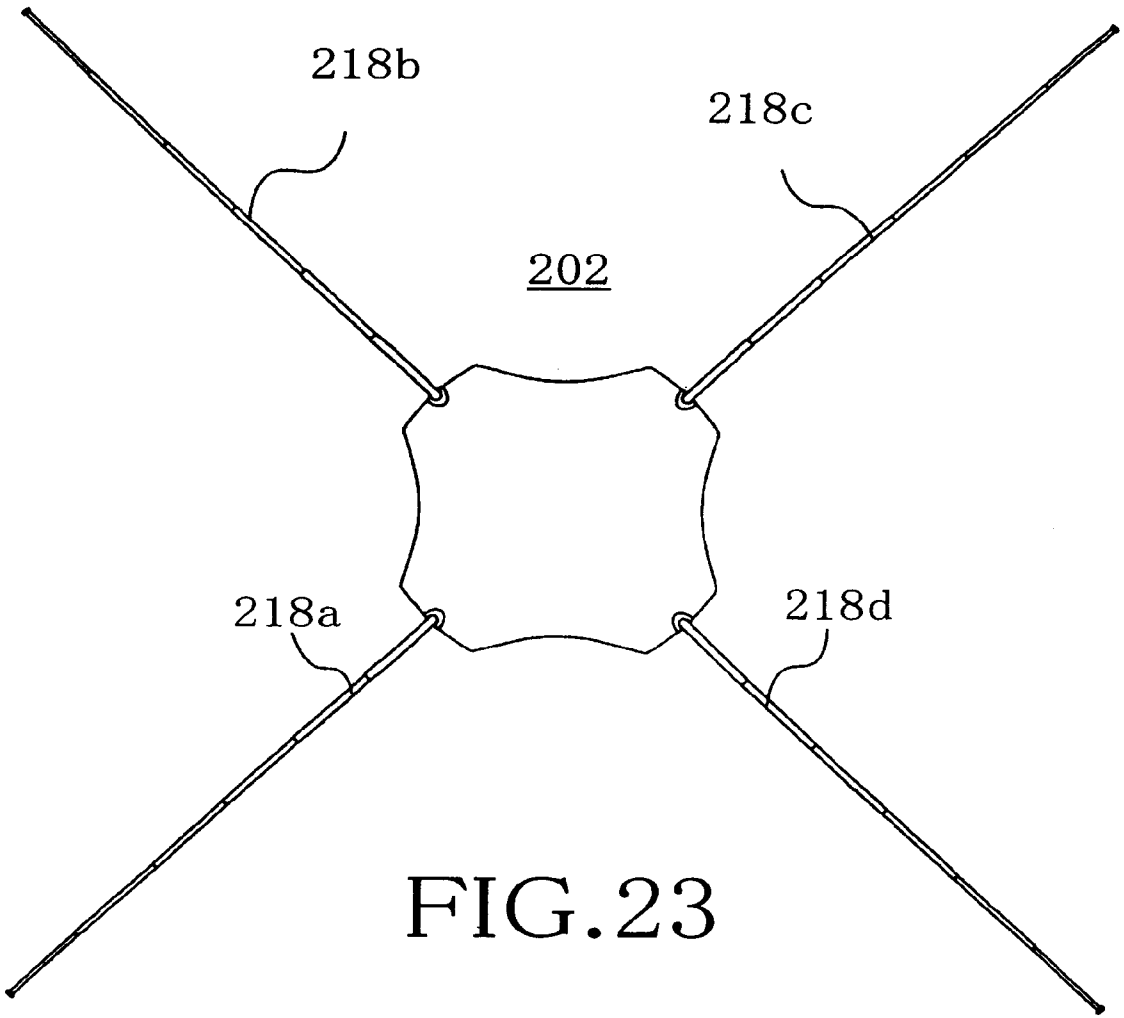
FIG. 23 is a plan view of an antenna system according to a sixth embodiment of the present invention.

The antenna system has a body 202 as shown in FIG. 23. The body 202 is generally octagonal and flat in shape. As shown in FIG. 24, the body 202 has slightly convex sides 204*a*, 204*b*, 204*c* and 204*d*, which are angularly spaced one another by 90°. Between adjacent ones of the convex sides 204*a*–204*d*, the body 202 also has concave sides 206*a*, 206*b*, 206*c* and 206*d*. The concave sides 206*a*–206*d* connect adjacent ones of the convex sides 204*a*–206*d*.

Figure 24A:
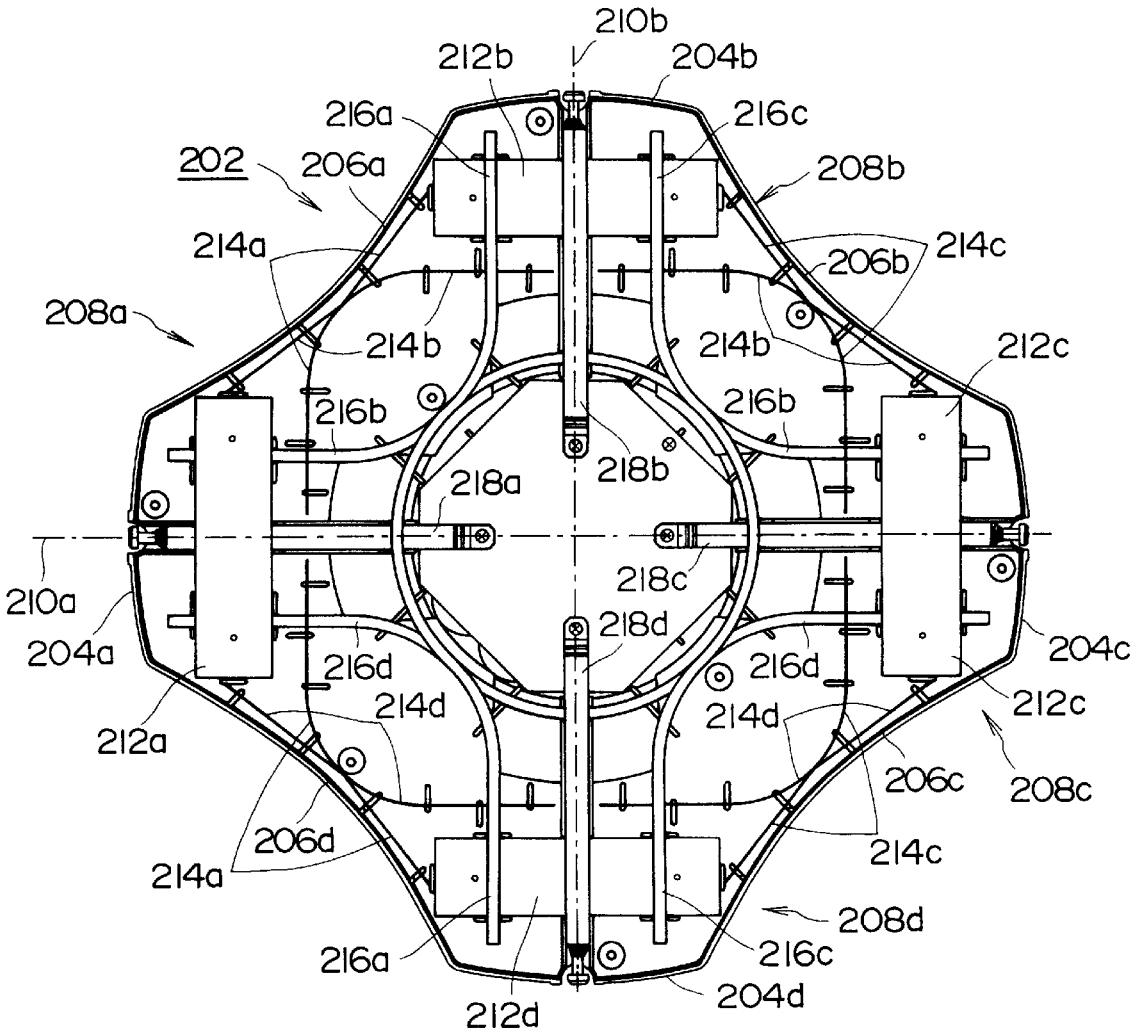
FIG. 24A is a plan view showing the inside of the antenna system of FIG. 23, with the rod antennas retracted.
Figure 24B:
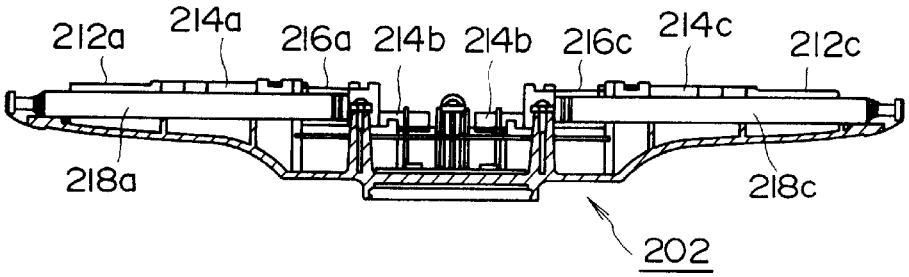
FIG. 24B is a cross-sectional view along a line 210*a* in FIG. 24A.
Figure 24C:
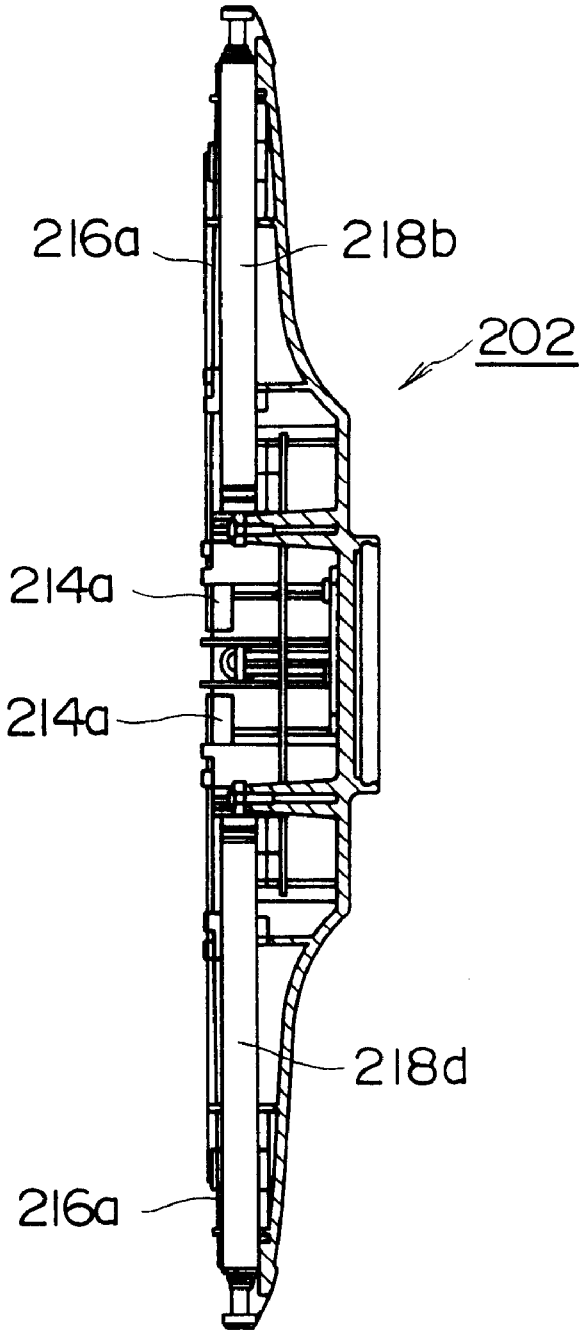
FIG. 24C is a cross-sectional view along a line 210*b* in FIG. 24A, in which the rods are shown not sectioned.
Figure 25:
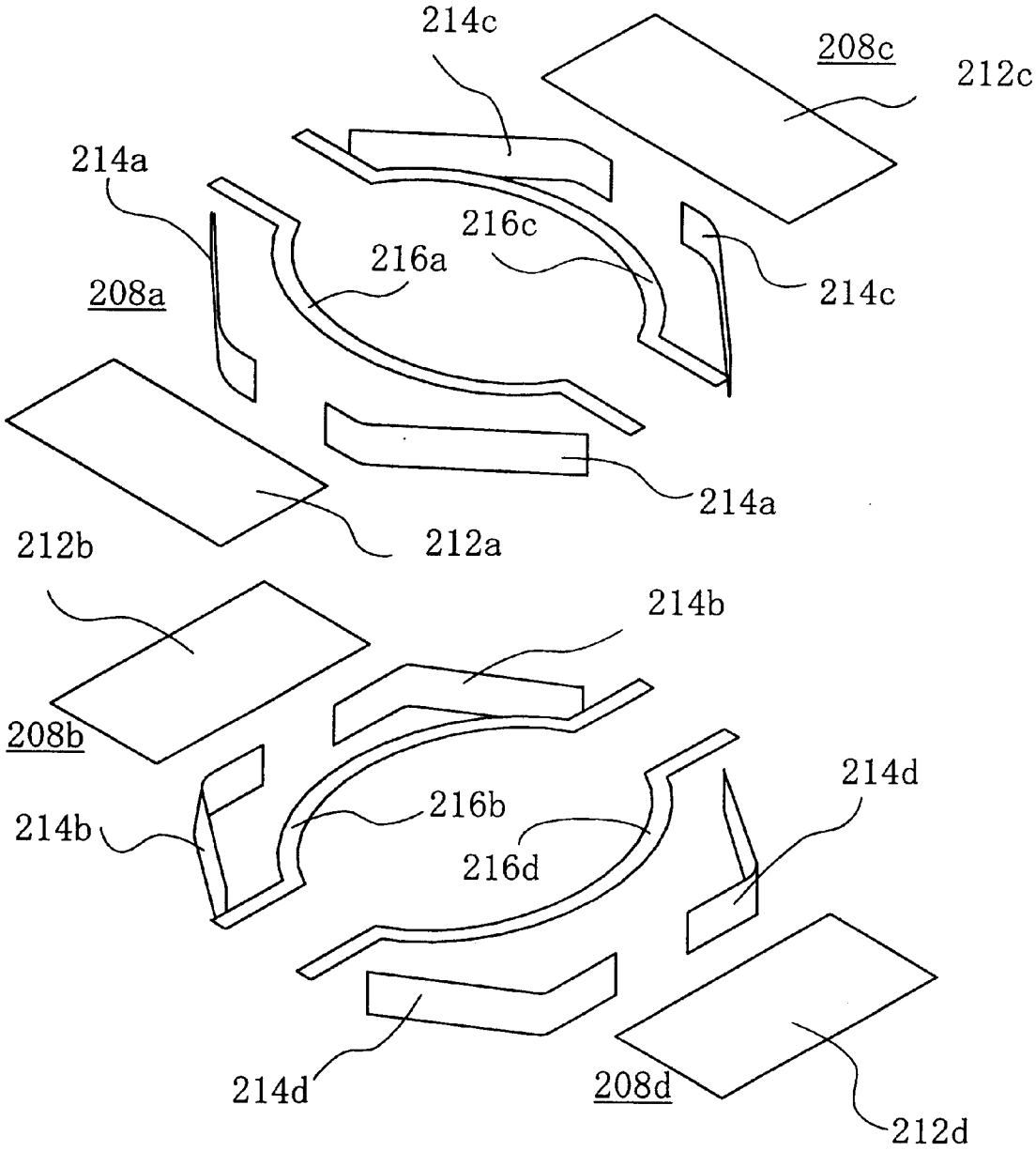
FIG. 25 is an exploded view of the UHF antenna of the antenna system shown in FIG. 24.

As shown in FIG. 24A, within the body 202, disposed are a plurality, e.g. four, of Yagi antennas 208*a*, 208*b*, 208*c* and 208*d* for a first frequency band, e.g. the UHF band. Two of the four Yagi antennas, e.g. the Yagi antennas 208*a* and 208*c*, are disposed on a line 210*a* connecting the opposing convex sides 204*a* and 204*c*, in one plane, for example, in a horizontal plane. The other two Yagi antennas 208*b* and 208*d* are disposed on a line 210*b* extending orthogonal to the line 210*a* in a horizontal plane at a different level, e.g. below the plane in which the Yagi antennas 208*a* and 208*c* lie. This relationship in position is schematically shown in FIG. 25.

As shown in FIG. 24A, the Yagi antennas 208*a* and 208*c* include directors 212*a* and 212*c*, respectively, which are disposed within-the body 202 at locations near the convex sides 204*a* and 204*c*. The directors 212*a* and 212*c* are planar and of the same size. They are disposed with their major surfaces lying horizontal, and their longer side extending perpendicular to the line 210*a*.

Radiators 214*a* and 214*c* are disposed inward of the directors 212*a* and 212*c*. The radiator 214*a* has feeding points on opposite sides of the line 210*a* and is formed of two elements extending generally perpendicularly to the line 210*a* from the respective feeding points to points near the concave sides 206*a* and 206*d*, respectively, and then curving inward to extend generally along the concave sides 206*a* and 206*d* to points near the convex sides 204*b* and 204*d*.

Figures 26A, 26B, 26C:
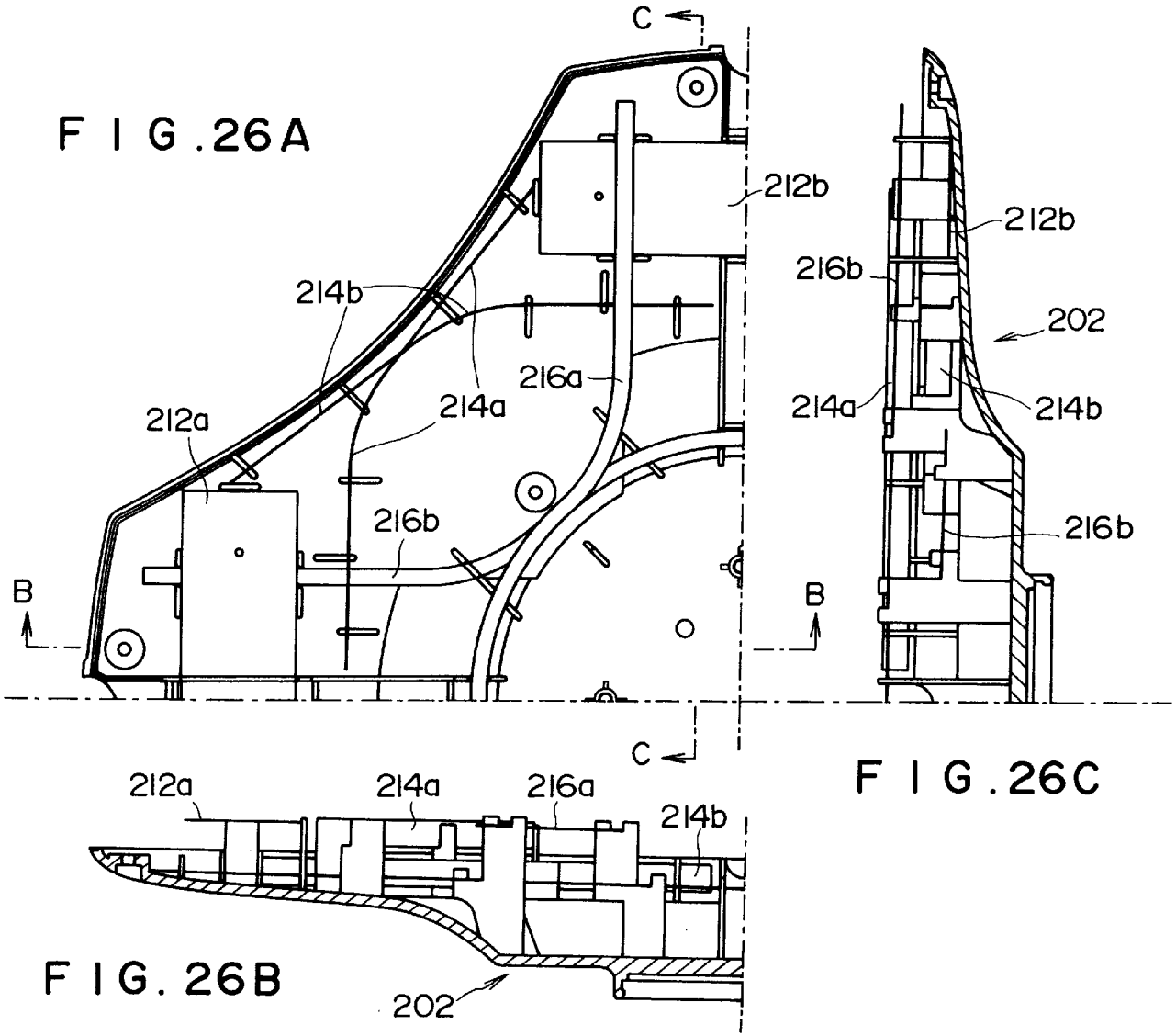
FIG. 26A is a plan view showing the inside of a quarter of the antenna system shown in FIG. 23.
FIG. 26B is a cross-sectional view along a line B—B in FIG. 26A.
FIG. 26C is a cross-sectional view along a line C—C in FIG. 26A.

The radiator 214*c* is arranged similar to the radiator 214*a*, as shown. The radiators 214*a* and 214*c* has a shape like an equal-sided trapezoid without base and with a smooth transition from the top to the sides. Bending in this manner, the radiators 214*a* and 214*c* can have a required length in a narrow space within the body 202. The radiators 214*a* and 214*c* are also planar, but, different from the directors 212*a* and 212*c* which have their major surfaces laid horizontal, they are disposed with this major surfaces lying in respective vertical planes. The upper edges of the radiators 214*a* and 214*c* are at substantially the same level as the major surfaces of the directors 212*a* and 212*c*, respectively, as shown in FIG. 26B. The radiators 214*a* and 214*c* are disposed with their major surfaces extending vertically so that they can be easily bent.

Reflectors 216*a* and 216*c* are disposed inward of the radiators 214*a* and 214*c*, respectively. The reflector 216*a* has straight end portions on opposite sides of the line 210*a* and a curved portion connecting the inner ends of the straight end portions. The curved portion is convex toward the director 212*a*. The reflector 216*c* is arranged similar to the reflector 216*c*. Due to this curving configuration, the reflectors 216*a* and 216*c* can have a required length. As shown in FIG. 26B, the reflector 216*a*, and, hence, the reflector 216*c*, are planar with their major surfaces facing horizontally, and their upper edges are flush with the major surfaces of the directors 212*a* and 212*c*, respectively.

The Yagi antennas 208*b* and 208*d* have a structure similar to that of the Yagi antennas 208*a* and 208*c*, and include directors 212*b* and 212*d*, radiators 214*b* and 214*d* and reflectors 216*b* and 216*d*, respectively. The Yagi antennas 208*b* and 208*d* are arranged along a line 210*b* to diagonally face each other. The line 210*b* orthogonally intersects the line 210*a* along which the Yagi antennas 208*a* and 208*c* are arranged. The Yagi antennas 208*b* and 208*d* are disposed at a lower level than the Yagi antennas 208*a* and 208*c* so that the upper and lower level antennas do not contact, as shown in FIG. 25.

The radiators 214*a* and 214*b* intersect without contacting with each other. Also, the radiators 214*b* and 214*c*, the radiators 214*c* and 214*d*, and the radiators 214*d* and 214*a* intersect without contacting each other, respectively, as shown in FIG. 24A. The reflector 216*a* intersects the reflectors 216*b* and 216*d* without contacting, and the reflector 216*c* intersects the reflectors 216*b* and 216*d* without contacting. The reflector 216*a* intersects also the radiators 214*b* and 214*d* and the directors 212*b* and 212*d* without contacting, the reflector 216*b* does the radiators 214*a* and 214*c* and the directors 212*a* and 212*c* without contacting, the reflector 216*c* does the radiators 214*b* and 214*d* and the directors 212*b* and 212*d* without contacting and the reflector 216*d* intersects the radiators 214*c* and 214*a* and the directors 212*c* and 212*a* without contacting.

The four sets of Yagi antennas 208*a*, 208*b*, 208*c* and 208*d* can be disposed in the narrow space of the body 202 by virtue of disposing the radiators, the directors and the reflectors to intersect as described above. The intersection does not cause large disturbance in the characteristics of the Yagi antennas 208*a*–208*d* since the set of antennas 208*a* and 208*c* and the set of antennas 208*b* and 208*d* are disposed at different levels and, therefore, the respective antennas do not interfere with one another. Also, since adjacent ones of the four antennas, e.g. the antennas 208*a* and 208*b*, are at different levels, they hardly interfere with each other.

By virtue of the above-described arrangements of the respective Yagi antennas 208*a*, 208*b*, 208*c* and 208*d*, they can receive radio waves coming from different directions, e.g. radio waves coming into the antenna system from the directions toward the convex sides 204*a*–204*d*. Thus, the Yagi antennas 208*a* through 208*d* constitute a single composite UHF antenna.

Also disposed within the body 202 are an even number greater than four of rod antennas, e.g. four rod antennas 218*a*, 218*b*, 218*c* and 218*d*. The rod antennas 218*a*–218*d* are arranged in a horizontal plane at a level intermediate the plane in which the Yagi antennas 208*a* and 208*c* are arranged and the plane in which the Yagi antennas 208*b* and 208*c* are arranged. The rod antennas 218*a* and 218*c* are arranged along the line 210*a* in the horizontal plane, and the rod antennas 218*b* and 218*d* are arranged along the line 210*b* in the horizontal plane. The rod antennas 218*a*–218*d* are shown fully retracted in FIGS. 24A, 24B and 24C, and can be extended out from the respective convex sides 204*a*–204*d* to any desired positions between the fully retracted positions shown in FIG. 24A and the fully extended positions shown in FIG. 23.

Figure 27A:
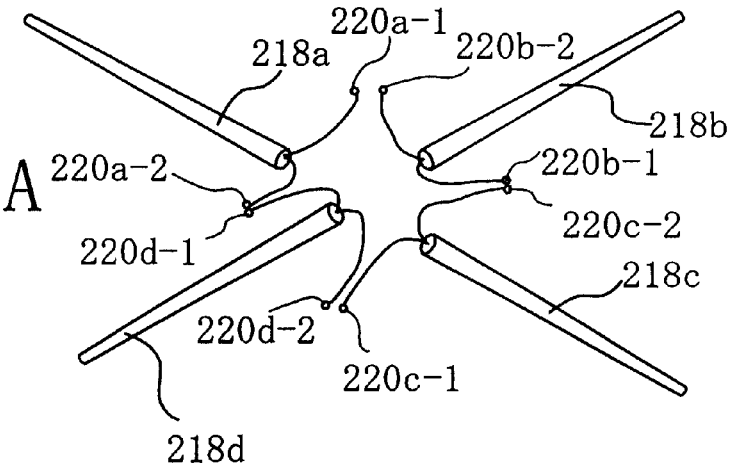
FIG. 27A is a perspective view of V-shaped antennas formed by the rod antennas of the antenna system shown in FIG. 23.
Figure 27B:
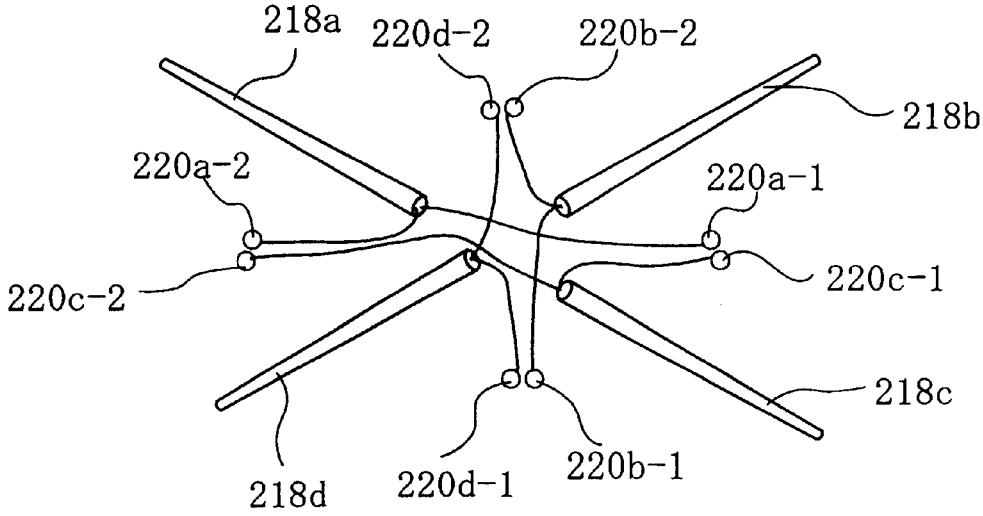

The rod antennas 218*a*, 218*b*, 218*c* and 218*d* are combined to provide the same number, four in the illustrated embodiment, of V-shaped antennas. More specifically, two feed terminals 220*a*-1 and 220*a*-2 are disposed at the innermost end of the rod antenna 218*a*, as shown in FIGS. 27A or 27B. Similarly, the rod antennas 218*b*, 218*c* and 218*d* are provided with two feed terminals 220*b*-1 and 220*b*-2, feed terminals 220*c*-1 and 220*c*-2, and feed terminals 220*d*-1 and 220*d*-2, at their respective innermost ends.

As shown in FIG. 27A, the rod antenna 218*a* and the adjacent antenna 218*b* are fed through one of the two feed terminals of the antenna 218*a* and one of the two feed terminals of the antenna 218*b*, for example, through the feed terminal 220*a*-1 and 220*b*-2. Similarly, the adjacent rod antennas 218*b* and 218*c* are fed through the feed terminals-220*b*-1 and 220*c*-2. The adjacent rod antennas 218*c* and 218*d* are fed through the feed terminals 220*c*-1 and 220*d*-2. The feed terminals 220*d*-1 and 220*a*-2 are used to feed the adjacent rod antennas 218*d* and 218*a*.

Alternatively, as shown in FIG. 27B, the two rod antennas arranged on the same line, for example, the rod antennas 218*a* and 218*c* may be used to form a dipole antenna, and the remaining two rod antennas 218*c* and 218*d* on the same line may be used to the other dipole antenna. Since two feed terminals are disposed on each of the rod antennas 218*a*, 218*b*, 218*c* and 218*d*, two pairs of feed terminals are led out from each dipole antenna. For example, the dipole antenna formed by the rod antennas 218*a* and 218*c* is provided with a pair of feed terminals 220*a*-1 and 220*c*-1 and a pair of feed terminals 220*a*-2 and 220*c*-2. Using these two pairs of feed terminals, a single dipole antenna can be used either of two dipole antennas having mutually reversed directional responses. Thus, although two rod antennas are used to form a single dipole antenna, the same number of dipole antennas as the rod antennas can be effectively provided. The rod antennas 218*a*, 218*b*, 218*c* and 218*d* provide a single composite VHF antenna.

The four V-shaped antennas or the four dipole antennas formed by the rod antennas 218*a*, 218*b*, 218*c* and 218*d* are hereinafter referred to as VHF antennas 222*a*, 222*b*, 222*c* and 222*d*. Also, the Yagi antennas 208*a*–208*d* are hereinafter referred to as UHF antennas 208*a*, 208*b*, 208*c* and 208*d*, respectively.

Figure 28:
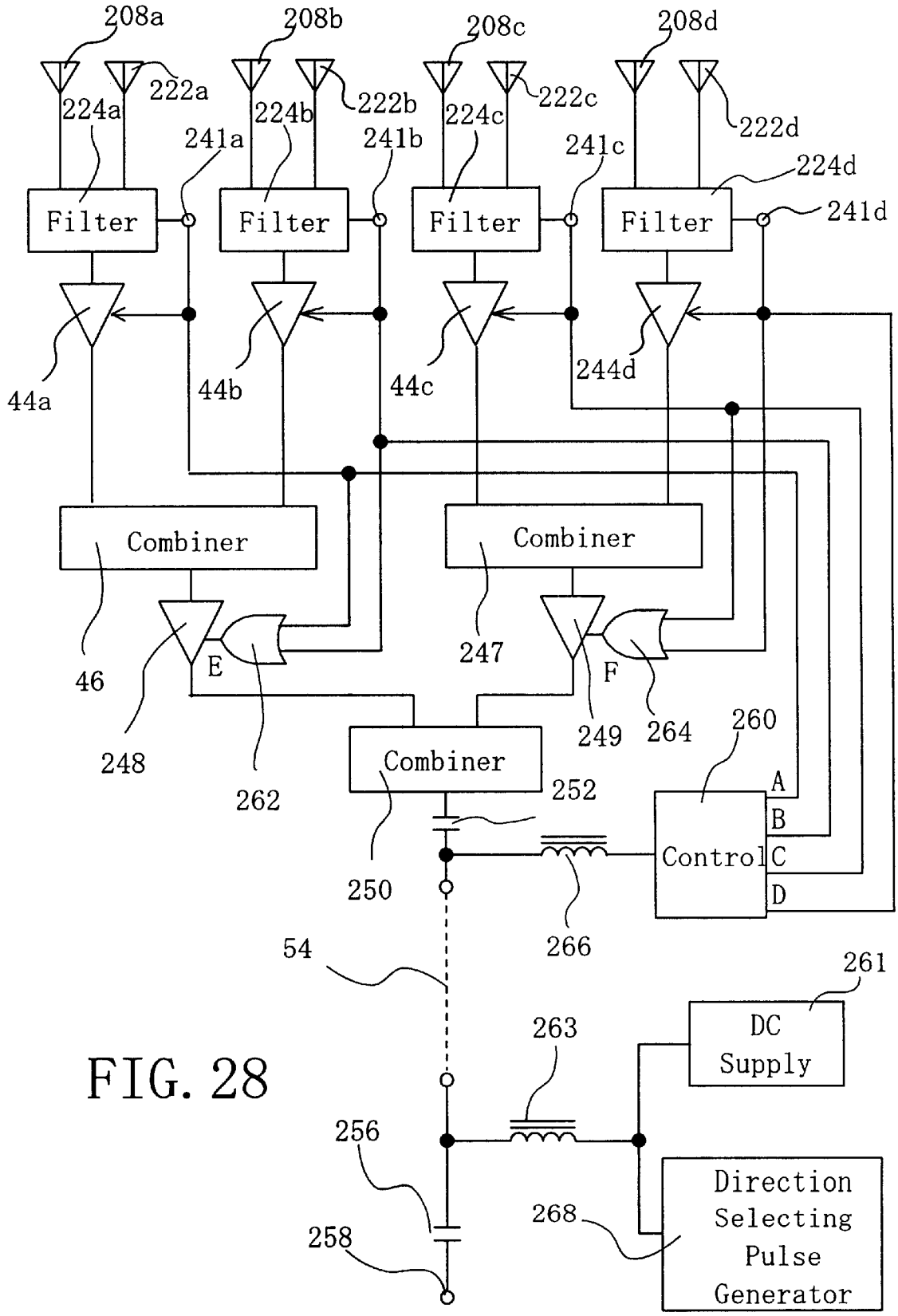
FIG. 28 is a block diagram of the rod antennas of the antenna system of FIG. 23.
Figure 29:
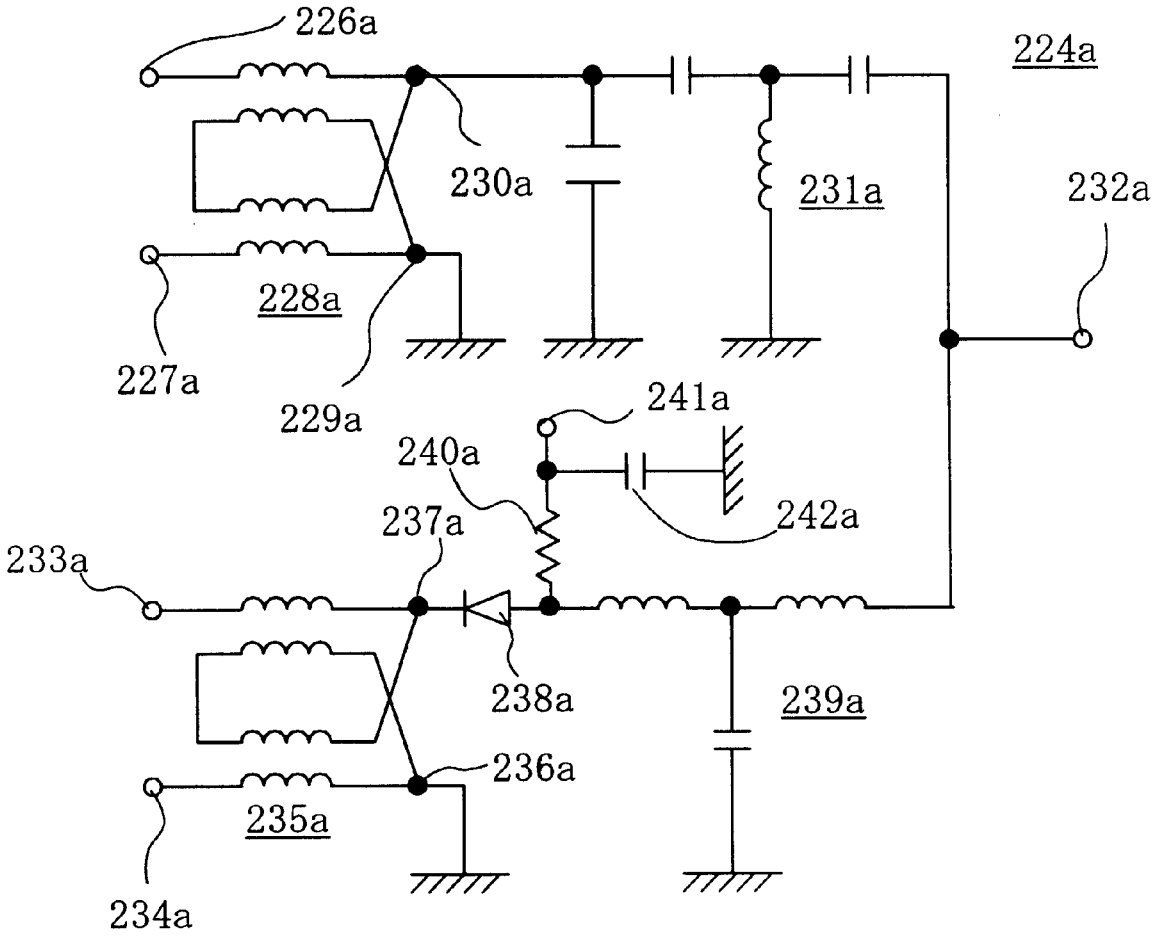
FIG. 29 is a block diagram of the filters shown in FIG. 28.

FIG. 28 shows a receiving system formed by the VHF antennas 222*a*, 222*b*, 222*c* and 222*d*, and the UHF antennas 208*a*, 208*b*, 208*c* and 208*d*. The VHF antenna 222*a* and the UHF antenna 208*a* are connected to a filter 224*a*. The VHF antenna 208*b* and the UHF antenna 222*b*, the VHF antenna 208*c* and the UHF antenna 222*c*, and the VHF antenna 208*d* and the UHF antenna 222*d* are connected to filters 224*b*, 224*c* and 224*d*, respectively.

The filter 224*a* has input terminals 226*a* and 227*a* to which the UHF antenna 208*a* is connected, as shown in FIG.

29. The input terminals 226*a* and 227*a* are connected to a matching device 228*a* for the UHF band. The UHF matching device 228*a* has two output terminals 229*a* and 230*a*. The output terminal 229*a* is connected to a reference potential, e.g. the ground. The output terminal 230*a* is connected to an output terminal 232*a* of the filter 224*a* through a high-pass filter 231*a* having its pass band adjusted to pass therethrough television broadcast signal in the UHF band.

The filter 224*a* also has input terminals 233*a* and 234*a* to which the VHF antenna 222*a* is connected. The input terminals 233*a* and 234*a* are connected to a matching device 235*a* for the VHF band. The VHF matching device 235*a* has two output terminals 236*a* and 237*a*. The terminal 236*a* is connected to a reference potential, e.g. grounded, while the output terminal 237*a* is connected to the input of a low-pass filter 239*a* through switching means 238*a*, e.g. a unidirectional device, more specifically, a PIN diode. The output of the low-pass filter 239*a* is connected to the filter output terminal 232*a*. The PIN diode 238*a* has its cathode connected to the output terminal 237*a* of the matching device 235*a*, as described previously, and has its anode connected to the input of the low-pass filter 239*a* which is adjusted to pass television broadcast signals in the VHF band. The anode of the PIN diode 238*a* is connected to a power supply terminal 241*a* through a current-limiting resistor 240*a*. A bypass capacitor 242*a* is connected between the power supply terminal 241*a* and the ground.

The other filters 224*b*, 224*c* and 224*d* have the same configuration as the filter 224*a*, and, therefore, no detailed description is given to them. However, in the following description, the components of the filters 224*b*, 224*c* and 224*d* are denoted by the same reference numerals as used for the filter 224*a* with the suffix letter "b", "c" and "d" attached for the respective filters.

As shown in FIGS. 30A, 30B, 30C and 30D, the matching devices 228*a*, 228*b*, 228*c* and 228*d* in the respective filters 224*a*, 224*b*, 224*c* and 224*d* have their respective output terminals 229*a*, 229*b*, 229*c* and 229*d* grounded, and have their output terminals 230*a*, 230*b*, 230*c* and 230*d* connected to the associated high-pass filters 231, 231*b*, 231*c* and 231*d*. The matching devices 235*a*, 235*b*, 235*c* and 235*d* have their output terminals 236*a*, 236*b*, 236*c* and 236*d* grounded, and have their respective output terminals 237*a*, 237*b*, 237*c* and 237*d* connected to the associated PIN diodes 238*a*, 238*b*, 238*c* and 238*d*. The described connections are for aligning the phases of received signals in the UHF or VHF band developed at the output terminals 232*a*, 232*b*, 232*c* and 232*d*.

When the rod antennas 218*a*, 218*b*, 218*c* and 218*d* are used as dipole antennas, two rod antennas, e.g. the rod antennas 218*a* and 218*c*, arranged in a line, may have a pair of output terminals 220*a*-1 and 220*c*-1 connected to the input terminals 233*a* and 234*a* of the matching device 235*a*. In this case, the other pair of output terminals 220*a*-2 and 220*c*-2 are connected to the input terminals 234*c* and 233*c* of the matching device 235*c*, respectively.

Returning to FIG. 28, output signals from the respective filters 224*a*–224*d* are applied to associated amplifier means, e.g. amplifiers, 244*a*, 244*b*, 244*c* and 244*d* which can amplify signals in the VHF and UHF bands. Output signals from the amplifiers 244*a* and 244*b* are applied to a combining circuit 246, and output signals from the amplifiers 244*c* and 244*c* are applied to a combining circuit 247. Output signals from the combining circuits 246 and 247 are amplified in amplifiers 248 and 249, respectively, which have a configuration similar to that of the amplifiers 244*a*–244*d*, and, then, are combined in a combining circuit 250.

An output signal of the combining circuit 250 is delivered indoors through a DC blocking capacitor 252 and a transmission line 254, e.g. a coaxial cable, and applied through a DC blocking capacitor 256 to a supply terminal 258 adapted for connection to a television receiver.

When the filters 224*a*, 224*b*, 224*c* and 224*d* receive DC voltages at the associated power supply terminals 241*a*, 241*b*, 241*c* and 241*d* through a control circuit 260, the PIN diodes 238*a*, 238*b*, 238*c* and 238*d* become conductive, so that the matching devices 235*a*, 235*b*, 235*c* and 235*d* are connected to the respective low-pass filters 239*a*, 239*b*, 239*c* and 239*d*. Similarly, the amplifiers 244*a*, 244*b*, 244*c* and 244*d* are rendered operative when they receive a DC voltage through the control circuit 260. The amplifier 248 is rendered operative when at least one of the amplifiers 244*a* and 244*b* is supplied with a DC voltage, which, in turn is applied to the amplifier 248 via an output terminal E of an OR circuit 262. When a DC voltage is applied to at least one of the amplifiers 244*c* and 244*d*, it is coupled to the amplifier 249 through an output terminal F of an OR circuit 264, which renders the amplifier 249 operative.

The control circuit 260 has an output terminal A coupled to the filter 224*a* and the amplifier 244*a*, an output terminal B coupled to the filter 224*b* and the amplifier 244*b*, an output terminal C coupled to the filter 224*c* and the amplifier 244*c*, and an output terminal D coupled to the filter 224*d* and the amplifier 244*d*. The control circuit 260 receives DC power from an indoor DC power supply 261 through a high-frequency blocking coil 263, a coaxial cable 254 and a high-frequency blocking coil 266. Via the same path, a pulse signal is supplied from a receiving direction selecting pulse generator 268 to the control circuit 260.

The filters 224*a*–224*d*, the amplifiers 244*a*–244*d*, the combining circuits 246 and 247, the amplifiers 248 and 249, the OR circuits 262 and 264, the combining circuit 250, the DC blocking capacitor 252, a high-frequency blocking coil 266 and the control circuit 260 can be disposed in the body 202.

Figure 31:
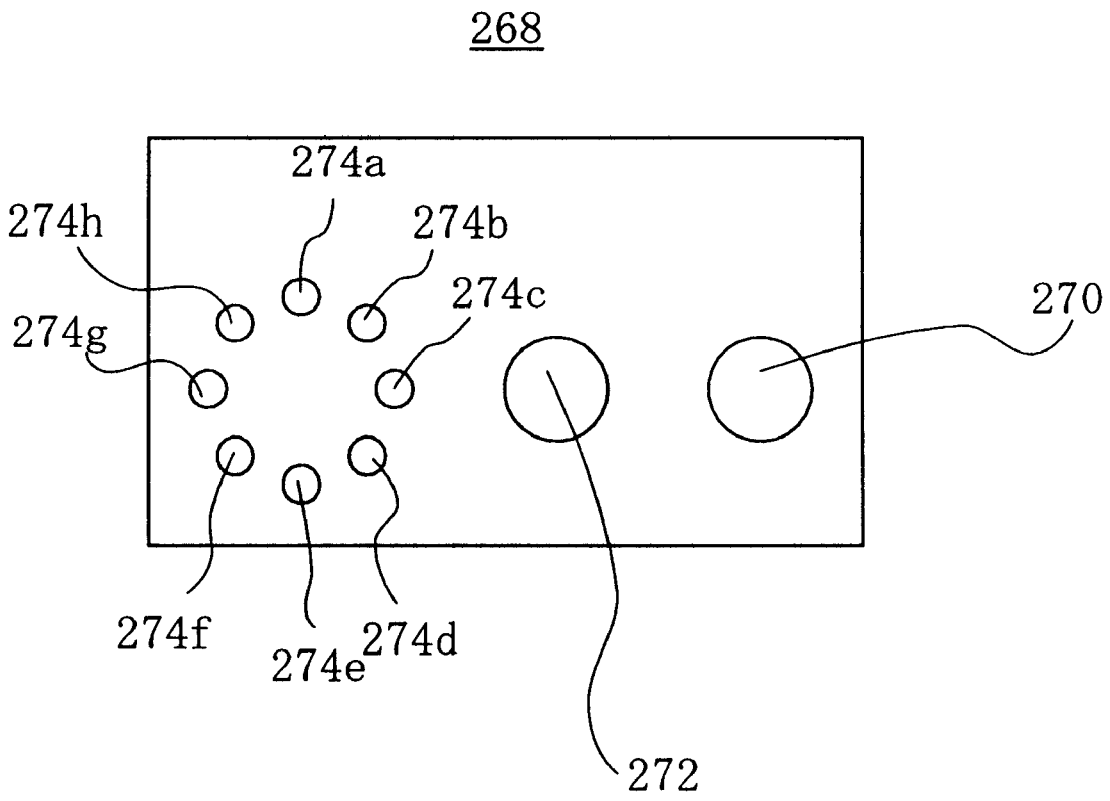
FIG. 31 is a front view of a receiving direction selecting pulse generator shown in FIG. 28.
Figures 32A, 32B, 32C, 32D, 32E, 32F, 32G:
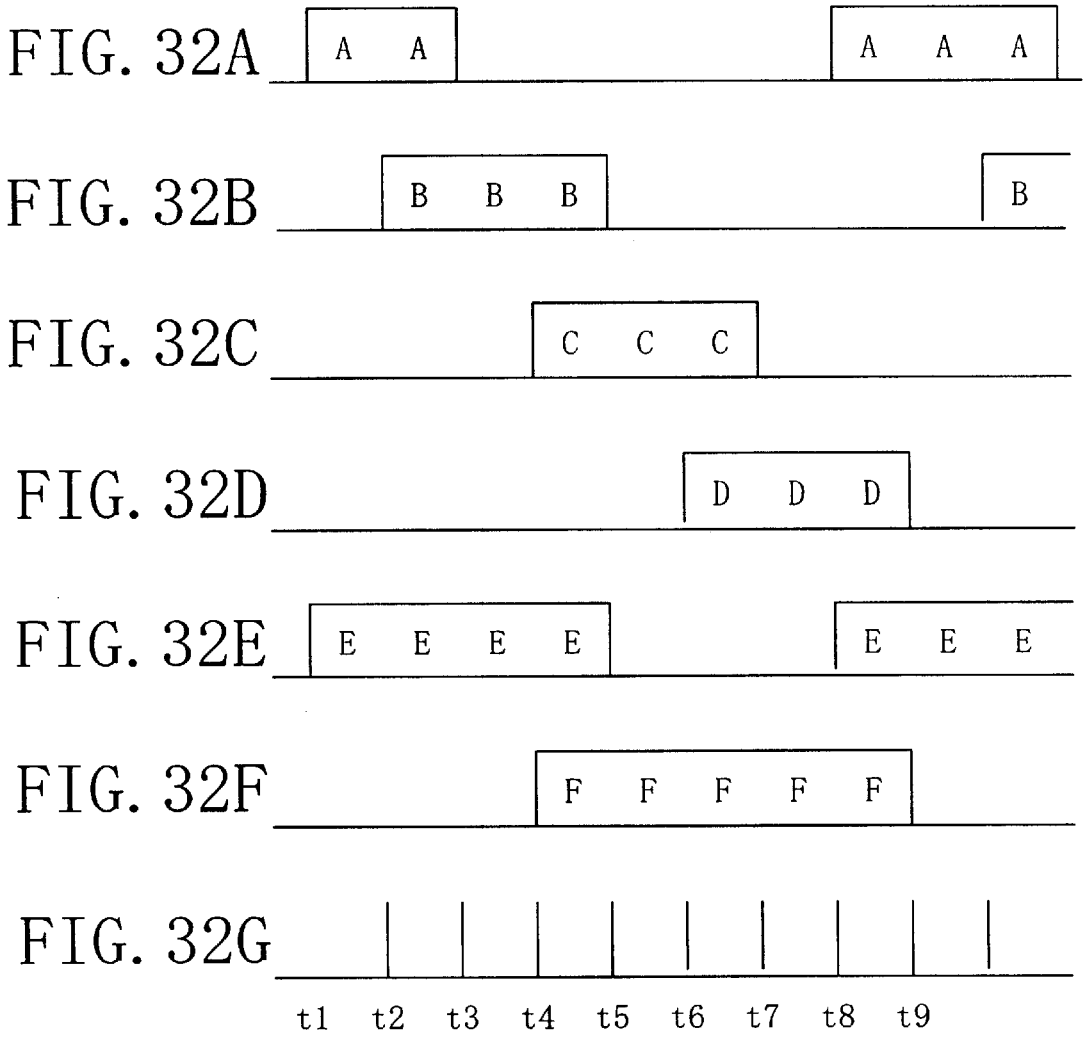
FIGS. 32A through 32G are diagrams used in explaining the operation of the receiving direction selecting pulse generator.
Figure 33A:
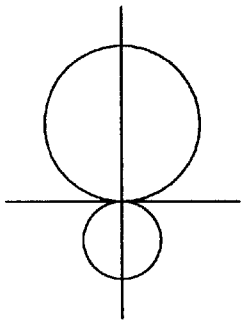
FIGS. 33A through 33H shows how the directional response characteristic in the UHF band of the antenna system shown in FIG. 23 changes.
Figure 33B:
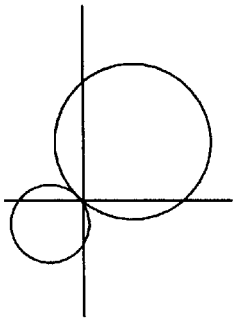
Figure 33C:
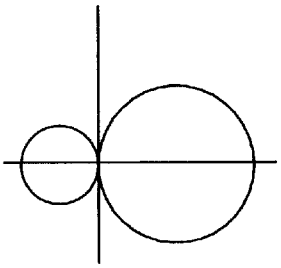
Figure 33D:
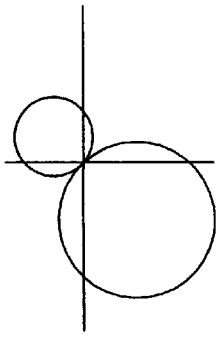
Figure 33E:
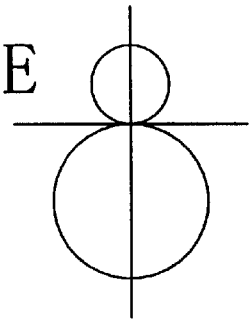
Figure 33F:
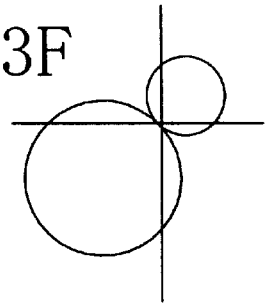
Figure 33G:
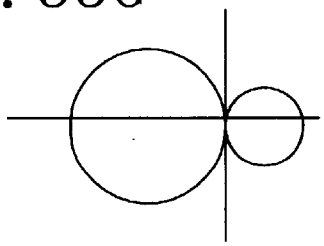
Figure 33H:
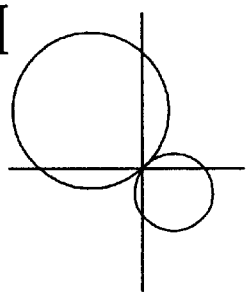

The direction selecting pulse generator 268 has a power supply switch 270 and a direction selecting switch 272, as shown in FIG. 31. Each time the switch 272 is operated, a pulse signal as shown in FIG. 32G is applied to the control circuit 260. Beside the direction selecting switch 272, eight light-emitting devices, e.g. LEDs 274*a*, 274*b*, 274*c*, 274*d*, 274*e*, 274*f*, 274*g* and 274*h*, are arranged in a circle. When the power supply switch 270 is turned on, the LED 274*a*, for example, is energized to emit light. By operating the direction selecting switch 272, the LED 274*a* is deenergized, and, instead, the LED 274*b* is energized to emit light. In the same manner, the LED to be energized is switched each time the switch 272 is operated.

Let it be assumed that the power supply switch 270 is turned on at a time t1 (FIG. 32G). Then, the control circuit 260 provides a DC voltage at the output terminal A as shown in FIG. 32A. It renders the PIN diode 238*a* in the filter 224*a* conductive and also causes the amplifier 244*a* operative. At the same time, a DC voltage is developed at the output terminal E of the OR circuit 262, as shown in FIG. 32E, which causes the amplifier 248 to operate.

Accordingly, signals received by the UHF antenna 208*a* and the VHF antenna 222*a* are applied to the input terminal 258 through the filter 224*a*, the amplifier 244*a*, the combining circuit 246, the amplifier 248, the combining circuit 250, the DC blocking capacitor 252, the coaxial cable 254 and the DC blocking capacitor 256.

When the switch 272 of the receiving direction selecting pulse generator 268 is operated at a time t2, a pulse signal shown in FIG. 32G is applied to the control circuit 260 so as to cause a DC voltage to be developed at the output terminals A and B of the control circuit 260 as shown in FIGS. 32A and 32B. This renders the PIN diodes 238*a* and 238*b* in the filters 224*a* and 224*b* conductive and also causes the amplifiers 244*a* and 244*b* to be operative. At the same time, as shown in FIG. 32E, a DC voltage is developed at the output terminal E of the OR circuit 62, which renders the amplifier 248 operative. As a result, signal received by the UHF antennas 208*a* and 208*b* are applied to the filters 224*a* and 224*b*, respectively, and are amplified in the amplifiers 244*a* and 244*b*, respectively. The amplified signals from the amplifiers 244*a* and 244*b* are combined in the combining circuit 246. Similarly, signals received by the VHF antennas 222*a* and 222*b* are applied through the respective filters 224*a* and 224*b* to the amplifiers 244*a* and 244*b* where they are amplified. The amplified signals are combined in the combining circuit 246. The outputs of the combining circuits 246 are amplified in the amplifier 248 and coupled to the input terminal 258 through the combining circuit 250, the DC blocking capacitor 252, the coaxial cable 254 and the DC blocking capacitor 256.

If the direction selecting switch 272 is operated at a time t3, a pulse signal shown in FIG. 32G is generated, and a DC voltage is available only at the output terminal B of the control circuit 260, as shown in FIG. 32B. Then, in a manner similar to the one described with reference to the time t1 above, signals received by the UHF antenna 208*b* and the VHF antenna 222*b* are amplified in the amplifiers 244*b* and 248*b* and coupled to the input terminal 258.

If the switch 272 is operated at a time t4, a pulse shown in FIG. 32G is generated, and DC voltages shown in FIGS. 32B and 32C are developed at the output terminals B and C of the control circuit 260, respectively. This causes signals received by the UHF antennas 208*b* and 208*c* and signals received by VHF antennas 222*b* and 222*c* are applied respectively through the filters 224*b* and 224*c* to the amplifiers 244*b* and 244*c*, where they are amplified. The outputs from the amplifiers 244*b* and 244*c* are applied through the combining circuits 246 and 247, respectively, to the amplifiers 248, and 249. Since DC voltages are developed at the output terminals E and F of the OR circuits 262 and 264, respectively, the amplifiers 248 and 249 are in the operative condition. Accordingly, the output signals of the combining circuits 246 and 247 are amplified in the amplifiers 248 and 249, respectively. The output signals from the amplifiers 248 and 249 are combined in the combining circuit 250, and the combining circuit output signal is coupled through the DC blocking capacitor 252, the coaxial cable 254 and the DC blocking capacitor 256 to the input terminal 258.

When the direction selecting switch 272 is operated at a time t5, a pulse signal shown in FIG. 32G is generated, and a DC voltage is developed only at the output terminal C of the control circuit 260. Then, signals received at the UHF antenna 208*c* and at the VHF antenna 222*c* are amplified in the amplifier 244*c*, and the amplified signals are applied through the combining circuit 247 to the amplifier 249. Since a DC voltage is also available at the output terminal F of the OR circuit 264, the amplifier 249 is operative to amplify the outputs of the combining circuit 247, and, the amplified outputs from the amplifier 249 is coupled through the combining circuit 250, the DC blocking capacitor 252, the coaxial cable 254 and the DC blocking capacitor 256 to the input terminal 258.

The switch 272 operated at a time t6 causes a pulse signal shown in FIG. 32G to be generated, so that a DC voltage is developed at the output terminals C and D of the control circuit 260 as shown in FIGS. 32C and 32D. Then, signals received by the UHF antennas 208*c* and 208*d* and signal received by the VHF antennas 222*c* and 222*d* are amplified in the amplifiers 244*c* and 244*d*, respectively. The amplified signals are coupled through the combining circuit 247 to the amplifier 249. Since a DC voltage is developed also at the output terminal F of the OR circuit 264, the amplifier 249 operates to amplify the output of the combining circuit 247. The amplified output from the amplifier 249 is coupled through the combining circuit 250, the DC blocking capacitor 252, the coaxial cable 254 and the DC blocking capacitor 256 to the input terminal 258.

When the direction selecting switch 272 is operated at a time t7, a pulse signal shown in FIG. 32G is generated, which causes a DC voltage to be developed at the output terminal D of the control circuit 260 as shown in FIG. 32D. Then, signals received by the UHF antenna 208*d* and the VHF antenna 222*d* are coupled through the filter 224*d* to the amplifier 244*d*. Since a DC voltage is developed at the output terminal F of the OR circuit 264, the amplified signals from the amplifier 244*d* are applied through the combining circuit 247 to the amplifier 249. The output signals from the amplifier 249 are coupled through the combining 250, the DC blocking capacitor 252, the coaxial cable 254 and the DC blocking capacitor 256 to the input terminal 258.

When the switch 272 is operated at a time t8, a pulse shown in FIG. 32G is generated, which causes DC voltages to be developed at the output terminals D and A of the control circuit 260 as shown in FIGS. 32A and 32D. Then, signals received at the UHF antennas 208*d* and 208*a* and signals received at the VHF antennas 222*d* and 222*a* are coupled through the respective filters 224*d* and 224*a* to the amplifiers 244*d* and 244*a*. The amplified signals are applied through the combining circuits 247 and 246 to the amplifiers 249 and 248, respectively. Since a DC voltage is also developed at the output terminals E and F of the OR circuits 262 and 264, respectively, the amplifiers 249 and 248 operate to amplify the signals from the combining circuits 247 and 246. The amplified signals from the amplifiers 249 and 248 are combined in the combining circuit 250, and the combined signals are coupled through the DC blocking capacitor 252, the coaxial cable 254 and the DC blocking capacitor 256 to the input terminal 258.

When the direction selecting switch 272 is operated at a time t9, a DC voltage is developed at the output terminal A, and operation similar to the one taking place at the time to takes place.

As described above, each time the direction selecting switch 272 is operated, the directional response of a UHF antenna apparatus provided by the combination of the UHF antennas 208*a*–208*d* changes as shown in FIGS. 3A through 33H. Also, the directional response of a VHF antenna apparatus provided by the combination of the VHF antennas 222*a*–222*d* changes similarly. such changes result from successively employing an output of a single antenna, an output of a combination of two antennas, an output of a different single antenna, an output of a different combination of two antennas, and so forth. Accordingly, with this antenna system, television broadcast signals in the VHF and UHF bands coming from any directions can be received efficiently.

The PIN diodes 238*a*–238*d* of the respective filters 224*a*–224*d* to be rendered conductive are selected by the DC voltage developed at the output terminals A–D of the control circuit 260 to determine whether or not the associated matching device should be connected to the respective low-pass filters 239*a*–239*d*. This arrangement is employed because each of the VHF antennas 239*a*–239*d* is formed of two of the rod antennas 218*a*–218*d* each having a pair of feed terminals. For example, when one, for example, 220*a*-1, of a pair of output terminals 220*a*-1 and 220*c*-1 of the rod antennas 218*a* and 218*c* is connected to the input terminal 233*a* of the matching device 235*a* with the other output terminal 220*c*-1 connected to the other input terminal 234*a*, one, i.e. 220*a*-2, of the other pair of output terminals 220*a*-2 and 220*c*-2 is connected to the input terminal 234*c* of the matching device 235*c*, with the other output terminal 220*c*-2 connected to the input terminal 233*c*. If the PIN diodes 238*a*–238*d* were not used and the output terminal of each matching device were connected directly to the associated low-pass filter, each matching device would be affected by other matching devices to which that matching device is connected through the rod antennas to which they are connected in common. In order to avoid it, the only matching device connected to rod antennas which are currently receiving radio waves is connected to the associated low-pass filter.

As described above, in order to change the directional responses of the UHF and VHF antenna apparatuses provided by combining appropriate ones of the UHF antennas and combining appropriate ones of the VHF antennas, appropriate ones of the amplifiers 244*a*–244*d* to which signals are to be applied from the UHF and VHF antennas are selected. Accordingly, the directional responses for both of the UHF and VHF bands can be changed simultaneously. Also, it is not necessary to provide switches for selecting the antenna outputs other than for the amplifiers.

Further, if the control circuit 260 were disposed indoors, being separated from the antenna body 202, its output terminals A, B, C and.D would have to be individually connected to the respective amplifiers 244*a*, 244*b*, 244*c* and 244*d* in the body 202, which would require a lot of wiring. However, according to the present invention, the control circuit 260 is disposed within the body 202, and, therefore, it only requires a single coaxial cable through which a pulse signal is applied to the control circuit 260 to alter the directional responses.

Although the antenna system according to the sixth embodiment includes both VHF and UHF antennas, but either of VHF and UHF antennas only may be used. In such a case, signals applied to the amplifiers 244*a*–244*d* are outputs of the VHF or UHF antennas only.

The amplifier 248 has been described to be made operative when at least one of the amplifiers 244*a* and 244*b* is operating, but the amplifier 248 may be arranged to operate all the time. Also, the amplifier 249 may be arranged to operate all the time.

The constituent components of the Yagi antennas have been described to be flat, but rod-shaped components may be used instead.

What is claimed is:

1. A multiple frequency band antenna system comprising:

at least one dipole antenna for a first frequency band including a pair of rod elements arranged substantially in a line; and at least one Yagi antenna for a second frequency band higher than said first frequency band, said Yagi antenna having a radiator and a reflector, said radiator and reflector being spaced from each other on at least one of said rod elements and extending transverse to said at least one rod element.

2. The multiple frequency band antenna system according to claim 1 wherein said radiator is a folded dipole antenna.

3. The multiple frequency band antenna system according to claim 1 comprising a plurality of said dipole antennas and a plurality of said Yagi antennas, the rod elements of said dipole antennas being disposed to extend radially from a same center, the radiators of said Yagi antennas being disposed on the rod elements of said dipole antennas; and said antenna system further comprising selecting means for selecting outputs of said dipole antennas and also for selecting outputs of said Yagi antennas.

4. An antenna system comprising:

a Yagi antenna for a first frequency band including at least one director; and a plurality of Yagi antenna for a second frequency band higher than said first frequency band, having respective radiators disposed on said at least one director.

5. An antenna system comprising:

an antenna for a first frequency band including a pair of rod elements mounted on a boom; and an antenna for a second frequency band higher than said first frequency band, including a radiator and a reflector for the second frequency band, said radiator and reflector being spaced from each other and mounted on said boom generally in parallel with said rod elements so as to function as directors for the antenna for said first frequency band.

6. An antenna system comprising:

a body; and a plurality of Yagi antennas for a same frequency band disposed within said body, said Yagi antennas being located at different levels in said body and intersecting each other so as to be capable of receiving radio waves coming from different directions.

7. The antenna system according to claim 6 wherein a plurality of Yagi antennas are disposed in a plane at each of different levels so as to receive radio waves coming from different directions.

8. The antenna system according to claim 7 wherein two Yagi antennas are disposed in each plane so as to receive radio waves coming from opposite directions, each of said two Yagi antennas having a radiator and a reflector, each radiator comprising two elements disposed to extend in opposite directions generally along a top and sides of an equal-sided trapezoid with the distal ends of said two elements being near to the distal ends of said two elements of the other of said two Yagi antennas, said reflector of each Yagi antenna having a portion curving toward the radiator of that Yagi antenna.

9. An antenna system comprising:

a body; and a plurality of Yagi antennas so disposed within said body as to be able to receive radio waves coming from different directions, adjacent ones of said Yagi antennas being at different levels, Yagi antennas receiving radio waves coming from directions angularly spaced from each other by 180° being disposed in a same plane.

10. The antenna system according to claim 9 wherein each of said Yagi antennas is connected to a matching device associated therewith; and said antenna system further comprises selecting means for selecting individual outputs of said matching devices of said Yagi antennas and combinations of outputs of the matching devices of pairs of adjacent ones of said Yagi antennas, each of said matching devices having a first output terminal connected to a reference potential and a second output terminal connected to said selecting means.

11. An antenna system comprising:

an even number not smaller than four of rod antennas arranged to radially extend in a same plane, and a pair of feed terminals led from each of said rod antennas;

one of a pair of feed terminals of each rod antenna forming a first feed section with one of a pair of feed terminals of one of two rod antennas adjacent to that rod antenna, and the other of said pair of feed terminals of that rod antenna forming a second feed section with one of a pair of feed terminals of the other of said two adjacent rod antennas, whereby a V-shaped antenna is formed.

12. The antenna system according to claim 11 further comprising:

matching devices connected to respective ones of said pairs of feed terminals;

selecting means for selecting individual outputs of said matching devices of said V-shaped antennas and combined outputs of said matching devices of pairs of adjacent ones of said V-shaped antennas; and energizing means for energizing only the selected ones of said matching devices.

13. The antenna system according to claim 11 further comprising:

matching devices connected to respective ones of said pairs of feed terminals; and selecting means for selecting individual outputs of said matching devices of said V-shaped antennas and combined outputs of said matching devices of pairs of adjacent ones of said V-shaped antennas;

each of said matching devices having a first output terminal connected to a reference potential and a second output terminal connected to said selecting means.

14. An antenna system comprising:

a plurality of antennas for a same frequency band disposed to receive radio waves coming from different directions;

selecting means for selecting individual outputs of said antennas and combined outputs of pairs of adjacent ones of said antennas; and control means for providing a selection control signal to said selecting means.

15. An antenna system comprising:

a plurality of first antennas for a first frequency band disposed to receive radio waves in said first frequency band coming from different directions;

a plurality of second antennas for a second frequency band, disposed to receive radio waves in said second frequency band coming from different directions, said second antennas being associated with respective ones of said first antennas;

amplifying means equal in number to said first and second antennas, each of said amplifying means receiving outputs of one of said first antennas and one of said second antennas associated therewith;

combining means for combining outputs of said amplifying means; and control means for selecting a state in which said amplifying means are individually energized and a state in which that one of said amplifying means which receives outputs from a pair of adjacent ones of said first antennas.

16. An antenna system comprising:

a body;

a plurality of Yagi antennas disposed in said body at different levels to receive radio waves in a first frequency band coming from various directions; and a plurality of rod antennas disposed in said body at a level different from said levels of said Yagi antennas, to receive radio waves in a second frequency band coming from various directions.

17. A multidirectional antenna system comprising:

a plurality of dipole antennas each including a pair of rod antennas, said rod antennas of each dipole antenna being disposed on opposite sides of a point on one of a plurality of straight lines crossing each other at said point, a different one of said straight lines being associated with each of said plurality of dipole antennas; and two feed terminals led out from each of said rod antennas.

18. The antenna system according to claim 17 further comprising:

matching devices connected to respective ones of said pairs of feed terminals;

selecting means for selecting individual outputs of said matching devices of said dipole antennas and combined outputs of said matching devices of pairs of adjacent ones of said dipole antennas; and energizing means for energizing only selected one of said matching devices.

19. The antenna system according to claim 17 further comprising:

matching devices connected to respective ones of said pairs of feed terminals; and selecting means for selecting individual outputs of said matching devices of said dipole antennas and combined outputs of said matching devices of pairs of adjacent ones of said dipole antennas;

each of said matching devices having a first output terminal connected to a reference potential and a second output terminal connected to said selecting means.

* * * * *